US007010894B1

(12) United States Patent
Cappelle

(10) Patent No.: US 7,010,894 B1
(45) Date of Patent: Mar. 14, 2006

(54) COVERING, COVERING ELEMENTS AND INSTALLING AND DISASSEMBLING METHOD

(75) Inventor: Mark Gaston Maurits Cappelle, Staden (BE)

(73) Assignee: Flooring Industries LTD, Dublin (IR)

( * ) Notice: Subject to any disclaimer, the term of this patent is extended or adjusted under 35 U.S.C. 154(b) by 0 days.

(21) Appl. No.: 09/869,299

(22) PCT Filed: Nov. 11, 2000

(86) PCT No.: PCT/BE00/00138

§ 371 (c)(1),
(2), (4) Date: Oct. 9, 2001

(87) PCT Pub. No.: WO01/38668

PCT Pub. Date: May 31, 2001

(30) Foreign Application Priority Data

Nov. 23, 1999 (BE) ..... 9900759

(51) Int. Cl.
*E04F 13/08* (2006.01)

(52) U.S. Cl. ..... 52/480; 52/506.05; 52/506.1; 52/384; 52/489.1

(58) Field of Classification Search ..... 52/480, 52/489.1, 506.05, 506.06, 506.08, 506.09, 52/506.1, 384, 582.1, 592.1, 747.1
See application file for complete search history.

(56) References Cited

U.S. PATENT DOCUMENTS

| | | | | |
|---|---|---|---|---|
| 2,005,030 | A * | 6/1935 | Geisinger | 52/384 |
| 2,101,612 | A * | 12/1937 | Duffy | 52/468 |
| 2,653,686 | A * | 9/1953 | Routt | 52/506.08 |
| 4,033,083 | A * | 7/1977 | Fritz et al. | 52/489.1 |
| 4,395,858 | A * | 8/1983 | Gwyther | 52/506.09 |
| 4,432,182 | A * | 2/1984 | Addie et al. | 52/480 |
| 4,546,587 | A * | 10/1985 | Mosch | 52/506.08 |
| 4,635,424 | A | 1/1987 | Drapeau | |
| 4,987,712 | A * | 1/1991 | Mancuso | 52/387 |
| 5,887,331 | A * | 3/1999 | Little | 29/509 |
| 6,112,479 | A * | 9/2000 | Andres | 52/177 |
| 6,266,937 | B1 * | 7/2001 | Watanabe | 52/489.2 |
| 6,421,974 | B1 * | 7/2002 | Whitehouse et al. | 52/510 |
| 6,516,579 | B1 * | 2/2003 | Pervan | 52/403.1 |

FOREIGN PATENT DOCUMENTS

| | | |
|---|---|---|
| DE | 40 17 564 A | 12/1991 |
| DE | 91 17 169 U | 1/1997 |
| GB | 2 155 970 A | 10/1985 |

* cited by examiner

*Primary Examiner*—Basil Katcheves
(74) *Attorney, Agent, or Firm*—Bacon & Thomas PLLC

(57) ABSTRACT

A floor, ceiling or wall covering constituted of a number of successive panels and fixing means for the panels, the fixing means including holders which, by means of fixing parts, retain the panels in a disconnectable manner over a part of the thickness of the panels.

58 Claims, 14 Drawing Sheets

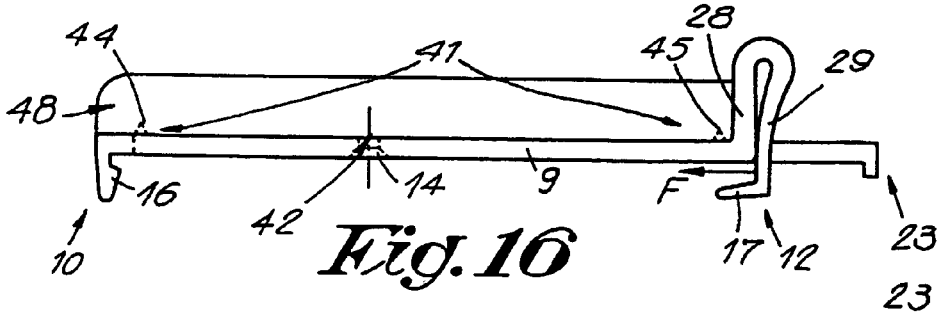
Fig. 16
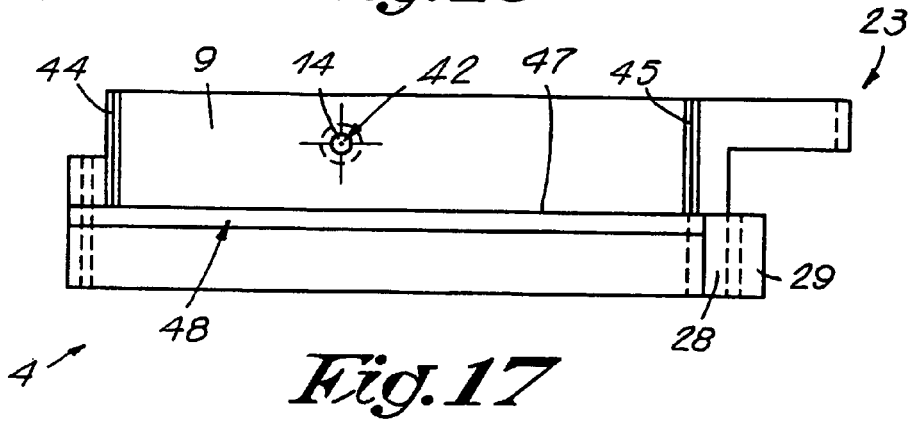
Fig. 17
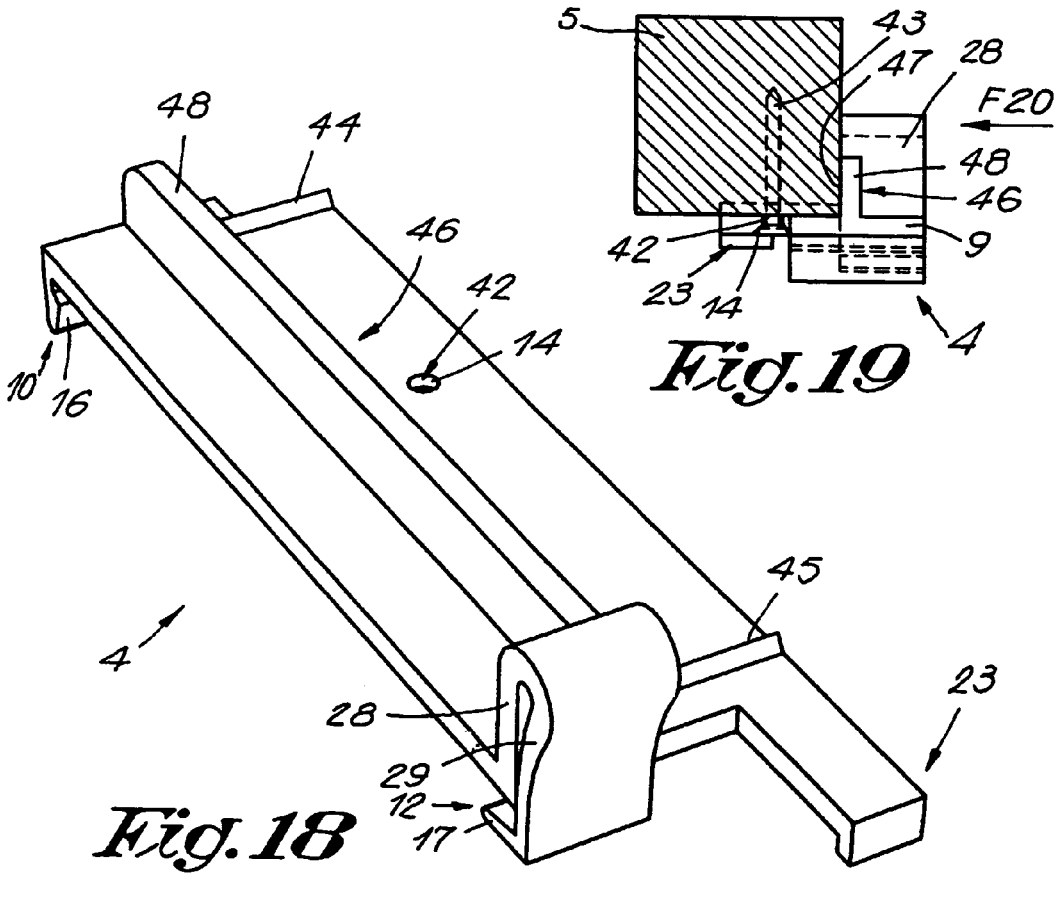
Fig. 19
Fig. 18

COVERING, COVERING ELEMENTS AND INSTALLING AND DISASSEMBLING METHOD

BACKGROUND OF THE INVENTION

A. Field of the Invention

The invention concerns a covering, in particular a floor, ceiling or wall covering, as well as elements to form such a covering.

B. Summary of the Invention

The invention relates to a covering which can be very easily applied and which preferably can also easily be disassembled.

For this purpose, the invention concerns a covering, in particular a floor, ceiling or wall covering, characterised in that it at least includes a number of successive panels on the one hand, and of fixing means therefor on the other hand, which fixing means comprise holders which retain the panels in a disconnectable manner by means of fixing parts, over a part of the thickness of the panels. The term 'to hold' can hereby imply, depending on the aimed embodiment, to fix, to surround, to interlock, to enclose or to clamp.

The covering contemplates panels, in particular laths, which are mounted in rows, whereby these panels can be removed, at least irrespective of the panels which are situated in the adjacent rows on either side. Thus is obtained that each row of panels can be freely removed, without being hindered by the panels situated next to it, so that a random part of the covering can be dismounted at any time, without damaging the rest of the covering. This part can be situated in the middle of the covering, and it is not necessary to disassemble the covering starting from the edge.

Use is preferably made of holders which are each provided with at least two fixing parts made in one piece with them, which can co-operate with two edges or portions of the panel respectively. These are preferably the opposite edges of one and the same panel, or portions situated near the edges. The use of such holders offers the advantage that the above-mentioned fixing parts per holder are each time situated at the same distance in relation to one another, as a result of which the co-operation with the edges or parts of the panels concerned is always guaranteed.

According to the invention, the holders preferably consist of separate elements, whereby each holder can mainly co-operate with a single panel or with a certain number of panels. As use is made of separate holders, they are easy to manipulate, and to manufacture as well, especially if they are designed to co-operate with only one panel respectively.

According to the most preferred embodiment, these separate holders are provided with a part forming a stop with which they can be positioned against an already installed part of the covering. Thus is obtained that the holders to be installed are easy to line up, simply by placing them with the stopping part against the edge of the already installed part of the covering.

The design of the holder is preferably such, on the side where the spacer is situated on the one hand, and on the opposite side thereof on the other hand, that when several such holders are mounted one after the other, the spacer of the one holder can be freely brought up to the edge of the panel which is being held by the other holder. Thus is obtained that the mutual positioning, even when the holders are put in line one after the other, is not determined by the contact between the holders themselves, but each time by the contact between said holder and the edge of the panel of the preceding row. Thus, the risk of certain deviations being cumulated is minimised.

The above-mentioned fixing parts preferably consist of hook-shaped elements co-operating with the edges of the panel, in particular clamping elements, one or several of which can be laterally moved or bent in a flexible manner, such that the panels can be snapped in the holders.

According to a special embodiment, one or more of these fixing parts have features which allow for a smooth, lateral, flexible bending, whereas a firm interlocking is provided for in a direction which is perpendicular to the surface of the covering. This offers the advantage that the panels can be put in the holders with little force, can be detached from them respectively on the one hand, but that, according to a direction which is perpendicular to the surface of the covering, a large force can be taken up on the other hand, so that for example in the case of a ceiling covering, accessories such as lighting fixtures and the like can be hung on the covering without any problem.

According to a practical embodiment, the above-mentioned features are formed in that the fixing parts consist of elastically bendable lips which are bent backward out of the plane of the holder, and then forward again to further form a hook-shaped part.

According to the most preferred embodiment, the holders are preferably equipped with a combination of one or more fixing parts on the one hand which are formed of elastically bendable lips which are bent backward out of the plane of the holder and then forward again to form a hook-shaped part, and of one or several fixing parts on the other hand which are equipped with a rather rigid hook-shaped part, whereby at least one of the fixing parts also has an inclined guiding part, such that a panel can be easily mounted by hooking it on one edge behind the fixing part concerned, and by subsequently forcing it over the guiding part in the second fixing part.

The panels preferably overlap near their edges, such that a closed covering is obtained. In particular, the panels preferably mesh near their edges, for example by means of a tongue and groove joint. This offers the advantage that the panels are coupled to one another over their full length, and cannot sag, bend respectively in relation to one another in certain places, and in particular in between the holders.

According to another preferred characteristic of the invention, the covering is characterised in that the panels, or possibly auxiliary elements working in conjunction with them, can mesh as such, but nevertheless can still be shifted laterally when mounted, against the spring force of the clamping parts, whereby the meshing is such that it is always possible to remove a single panel from between the adjacent panels by shifting it as mentioned above and by subsequently turning it down.

To this end, the holders are preferably equipped with fixing parts defining a seating for the panels which is positioned such that there is a lateral play between the panels of the successive rows, which play allows for the above-mentioned lateral shifting.

The above-mentioned holders may possibly be equipped with means which ensure a tight grip when the holders are being applied on a base, even when the holders are only fixed to the base in single point, for example by means of one nail, screw or staple. Thus is avoided that the holders can hinge around this single point.

According to the invention, the holders can also be provided with positioning means which simplify a quick positioning in relation to the base. According to a practical embodiment, these positioning means will consist of supporting means, such as a supporting surface, with which said holder can be forced laterally against the lath or such against which it is to be applied. Together with the bottom side of the holder, such a supporting surface then forms an L-shaped seating which allows for a smooth positioning. Moreover, this supporting surface prevents the holder from turning in case it is only fixed in a single point.

The invention is particularly meant for a covering whereby the panels consist of laths, but naturally it can also be applied in case of larger panels, for example in the shape of rectangular plates.

Further, the invention is also meant in the first place for panels which are hardly or not elastically deformable as such on their edges, especially for panels with a full core, in particular for panels which are composed of a composite material on the basis of wood, such as MDF or HDF.

Further, the invention also concerns a method for installing, disassembling such a covering respectively. The characteristics of this method, as well as other characteristics of the covering, will become clear from the following detailed description, as well as from the accompanying claims.

BRIEF DESCRIPTION OF THE DRAWINGS

In order to better explain the characteristics of the invention, hereafter some preferred embodiments are described hereafter as an example only without being limitative in any way, with reference to the accompanying drawings, in which:

FIGS. 16, 17 and 18 represent a variant of a holder according to the invention seen from aside, from above and in perspective respectively;

FIG. 19 represents the holder from FIGS. 16 to 18 when assembled;

DETAILED DESCRIPTION OF THE PREFERRED EMBODIMENTS

Figure 1:
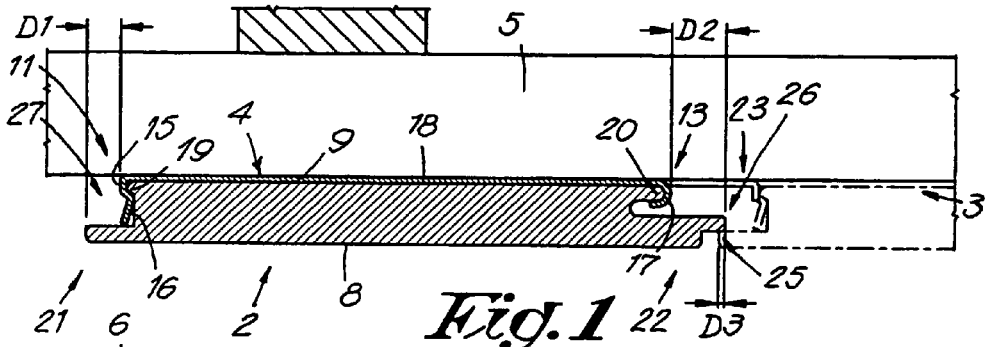
FIG. 1 represents a cross-section of a part of a covering, in particular a ceiling covering, according to the invention.
Figure 2:
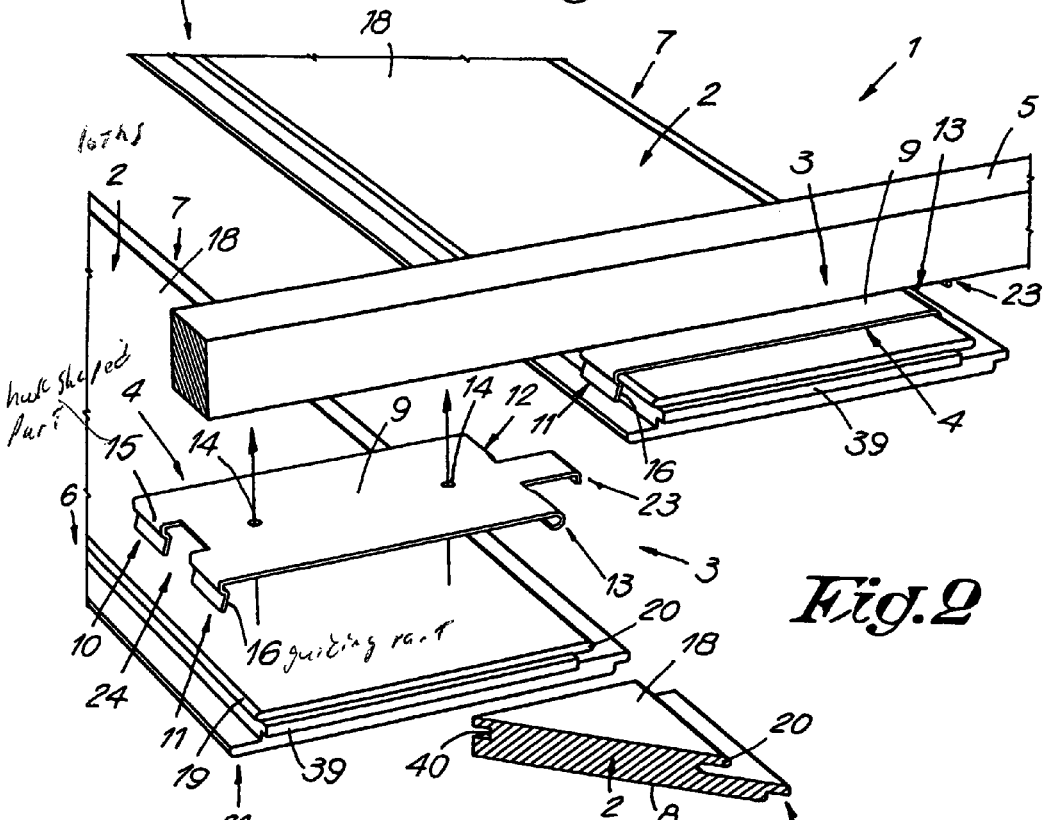
FIG. 2 is an exploded view of the covering from FIG. 1.
Figure 3:
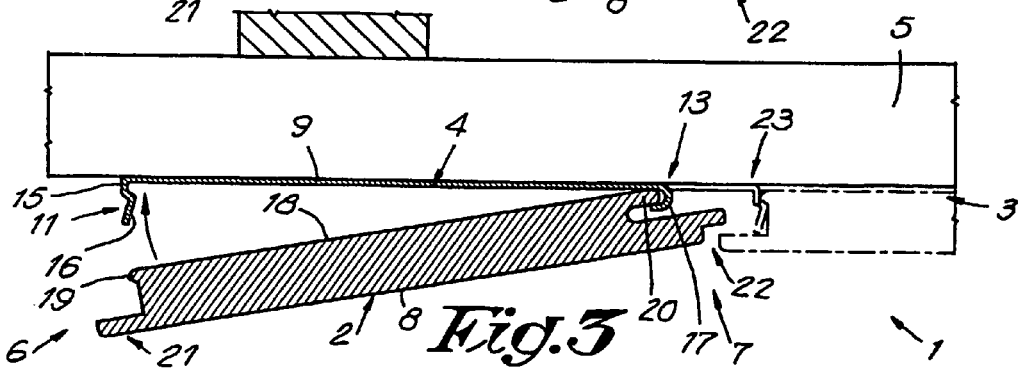
FIG. 3 represents the covering from FIG. 1 when being mounted.

As represented in FIGS. 1 to 3, the invention concerns a covering 1, in this case a ceiling covering. This covering consists of panels 2 on the one hand, and of fixing means 3 in the shape of holders 4 on the other hand which retain the panels 2 and which are fixed as such against the base, in this case a grid of laths 5.

In the given example, the panels 2 consist of laths which are provided with profiled edges 6 and 7. These laths preferably have a full core and are made of wood or a product on the basis of wood, in particular MDF, HDF or such. The profiled edges 6 and 7 are formed on the laths by means of milling or such. Naturally, these laths will be provided, at least on their visible side, in this case the bottom side 8, with a decorative surface which can be obtained in any way whatsoever.

In the given example, the holders 4 consist of separate elements which can be fixed against the laths 5.

Every holder 4 can co-operate with exactly one panel 2 and consists of a body 9 onto which are provided fixing parts 10–11 and 12–13 which can co-operate with the edges 6–7 of the panel 2 respectively. The panels 2 are hereby surrounded over a part of their thickness by these fixing parts.

The body 9 preferably consists of a plate-shaped part which is provided with openings 14 which make it possible to fix the holder 4 by means of screws, nails or such on the base.

The fixing parts 10–11 and 12–13 together form a fastening system in which the panels 2 can be snapped.

In the example of FIGS. 1 to 3, the fixing parts 10 to 13 to this end consist of hook-shaped lips, whereby in this case the fixing parts 10 and 11 are made such that they are suitable to be laterally bent in a flexible manner. In particular, the fixing parts 10 and 11 each consist of a lip with a hook-shaped part 15 and of a guiding part 16 formed at the free end thereof. The fixing parts 12 and 13 exclusively consist of hook-shaped parts 17 with a rather rigid design.

The panels 2 are provided at their edges 6 and 7 with collars 19 and 20 which can co-operate with the hook-shaped parts 15 and 17 respectively. On the reveal side, in this case the bottom side 8, are formed protruding parts 21 and 22 on the panels 2 which, when mounted, reach past the fixing parts 10–11 and 12–13, as indicated by the distances D1 and D2 in FIG. 1.

Further, the holders 4 are provided with a stopping part 23, in this case a protruding lip which functions as a spacer, such that this holder 4 can be positioned against a part of a covering which has already been installed before being fixed to the lath 5 or such.

The holder 4 hereby preferably has a design, as represented, which is such that when several such holders 4 are mounted in line one after the other, the spacer of this holder 4 can each time be brought freely up against the edge 6 of the already mounted panel 2. To this end, on each holder 4, opposite to the stopping part 23, is provided a portion in the shape of a recess 24 which leaves the edge 6 of the panel 2 concerned free. Practically, this is realised in the example in that the stopping part 23 is situated between the fixing parts 12 and 13, and the fixing parts 10 and 11 are situated at a distance from one another, in between which the recess 24 is formed.

When mounted, the panels 2 lying next to one another overlap, preferably over a short distance D3. This overlap is created as overlapping parts 25–26 are formed on the edges 6 and 7, whereby the part 26 takes place behind the part 25 in mounted position.

On the edge 6 there is a recess or free portion 27, as a result of which the panel 2 can be rotated freely along the overlapping part 26 of the panel 2 situated next to it, as represented in FIG. 3.

The assembly of the covering can be easily derived from the FIGS. 1 to 3.

First, a number of holders 4 are fixed at certain distances from one another on a base, in this case a lath structure. Then, a panel 2 as represented in FIG. 3 is put with the collar 20 in the hook-shaped parts 17, after which the panel 2 is simply pushed up on the other edge 6. Thus, the collar 19 snaps behind the hook-shaped part 15, as a result of which the panel 2 is fixed.

In order to mount the next row of panels 2, a new series of holders 4 is fixed to the laths 5, whereby these holders 4 are positioned against the collar 19 with their stopping part 23. Then, as described above, the following panel 2 can be snapped in the holders 4.

An important aspect of the preferred embodiment of the covering 1 according to the invention is that a row of panels 2 can always be freely removed from between the other rows, as a panel 2 can be turned down again without any problem thanks to the free portion 27.

Figure 4:
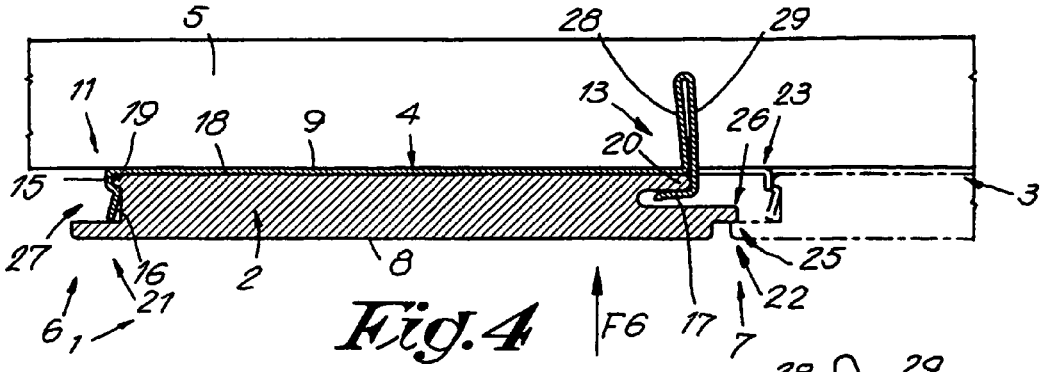
FIG. 4 represents a variant of a covering according to the invention.
Figure 5:
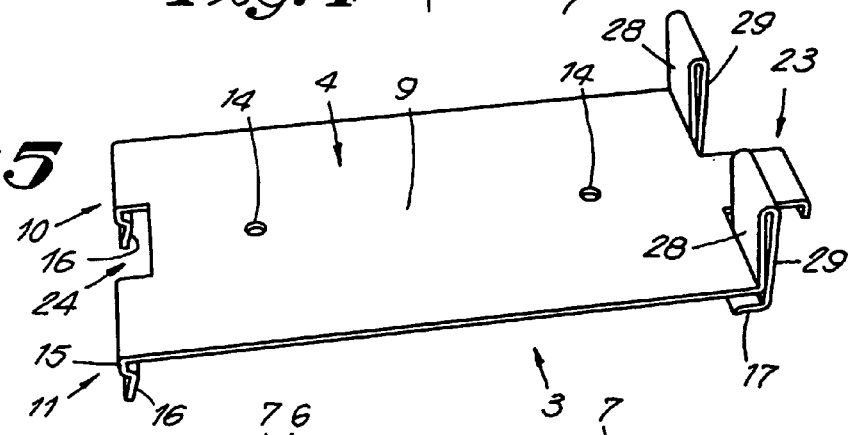
FIG. 5 represents a holder from the covering of FIG. 4 in perspective.

FIGS. 4 and 5 concern a variant in which the holder 4 is provided with fixing parts 12 and 13 which allow for a smooth lateral movement or bending thereof in a flexible manner, while a firm interlocking and bearing capacity is offered in a direction which is perpendicular to the surface of the covering 1. To this end, the fixing parts 12 and 13 consist of elastically bendable lips which are formed of a first part 28 which is bent backward, away from the plane of the body 9, and which is then connected to a second part 29 which is bent forward again, which finally forms a hook-shaped part 17.

According to the invention, the use of such fixing parts 12 and 13 is preferably combined with fixing parts 10 and 11 having a guiding part 16, such that the panel 2 can be simply snapped in by pushing it up. The guiding part 16, which is bevelled, ensures that the panel 2 is hereby laterally moved until it is snapped in.

It should be noted that the fixing parts 10 and 11 in this case must not necessarily be elastically bendable and may consist of rigid elements.

Figure 6:
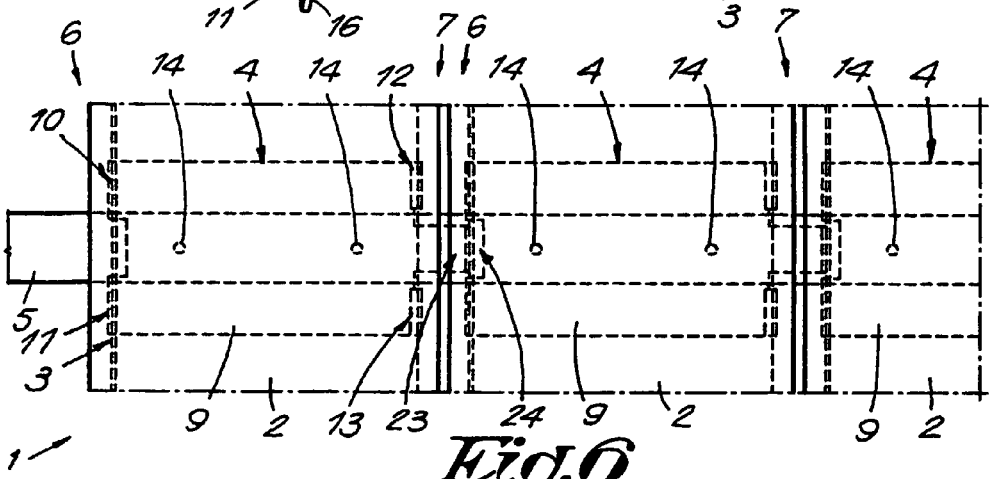
FIG. 6 represents a view according to arrow F6 in FIG. 4 to a smaller scale.

Finally, FIG. 6 represents how the stopping parts 23 of the holders 4 fit in the recesses 24 of each time the preceding holder 4.

Figure 7:
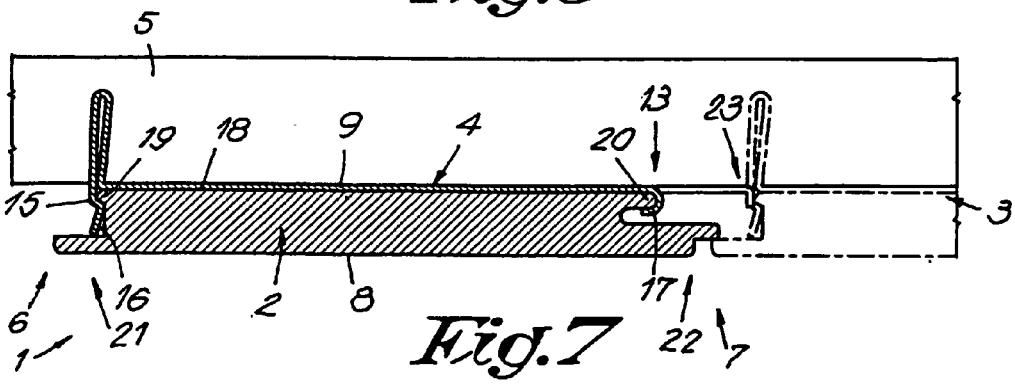
FIG. 7 shows a view similar to that of FIG. 4, but for a variant.

FIG. 7 represents a variant whereby the fixing parts 12 and 13 consist of rigid, hook-shaped parts 17, as in the embodiment of FIG. 1, whereas the fixing parts 10 and 11 are made analogous to the fixing parts 12 and 13 of FIG. 5.

Figure 8:
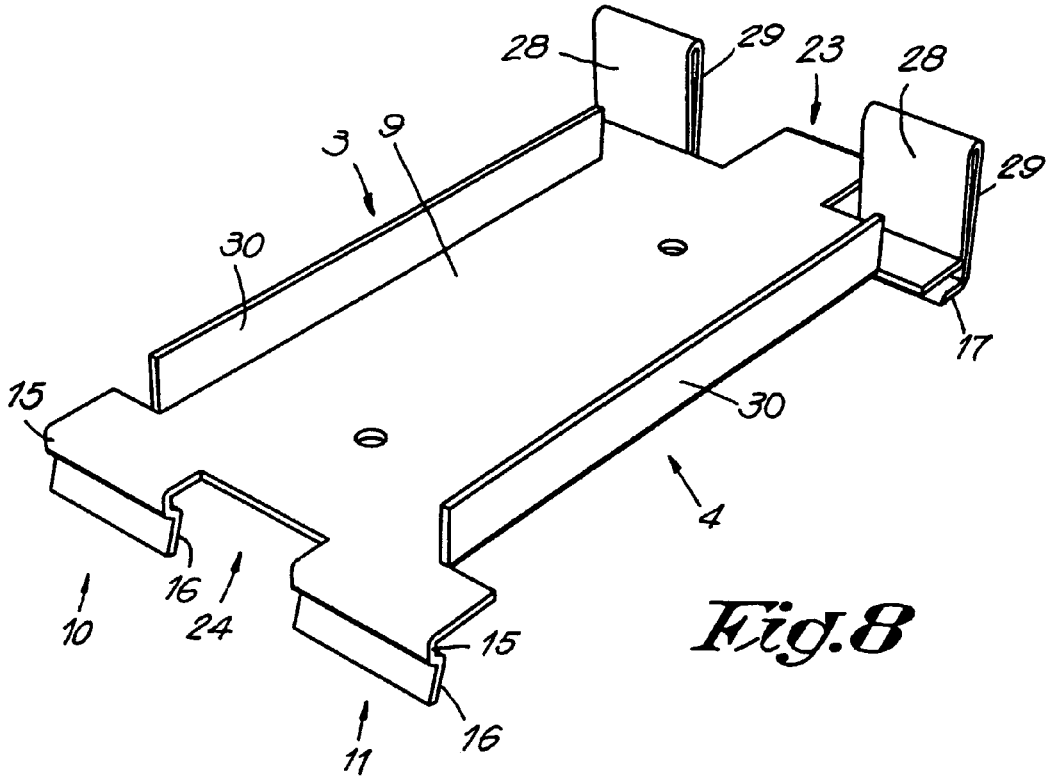
FIG. 8 shows another holder according to the invention.

FIG. 8 represents a variant of the holder 4, whereby the body 9 is provided with strengthening ribs 30 in the shape of bent flanges.

Figure 9:
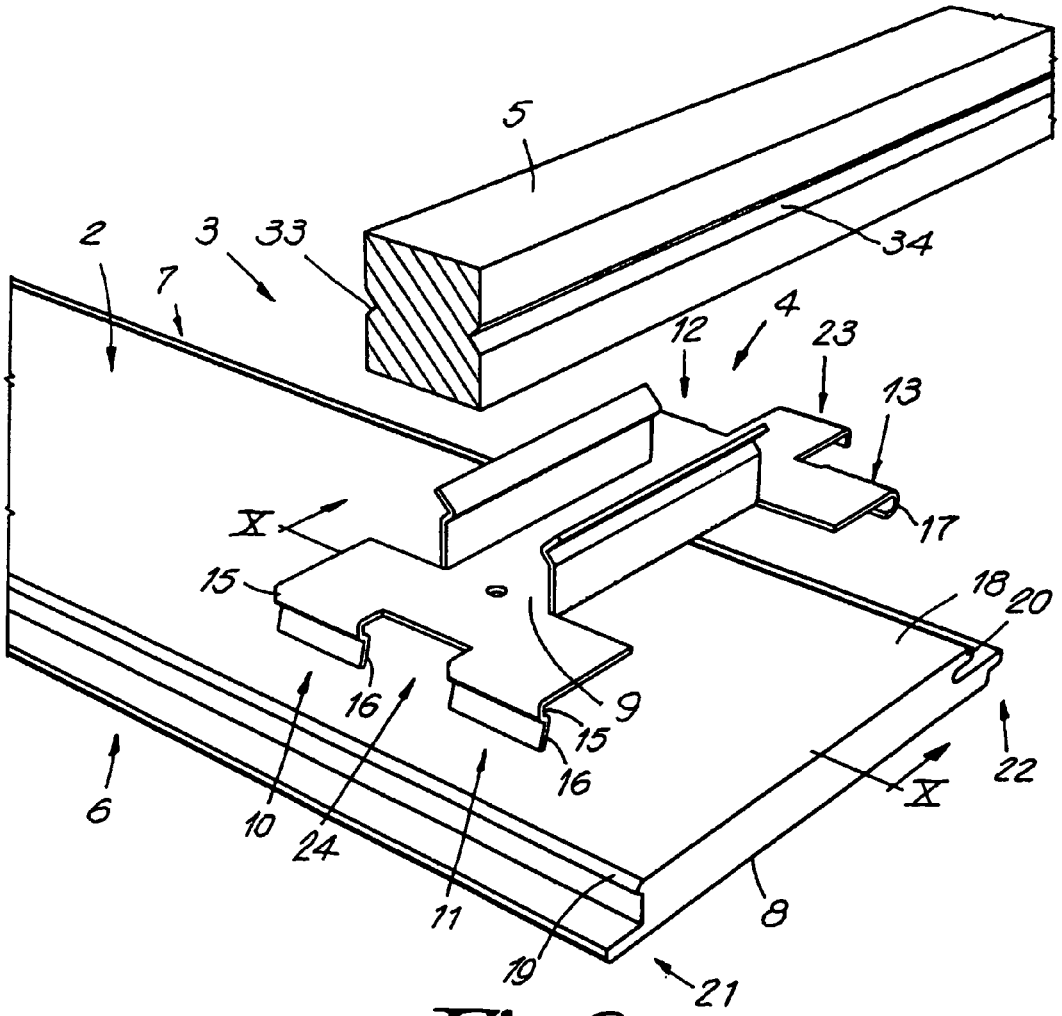
FIG. 9 shows another variant of the invention.
Figure 10:
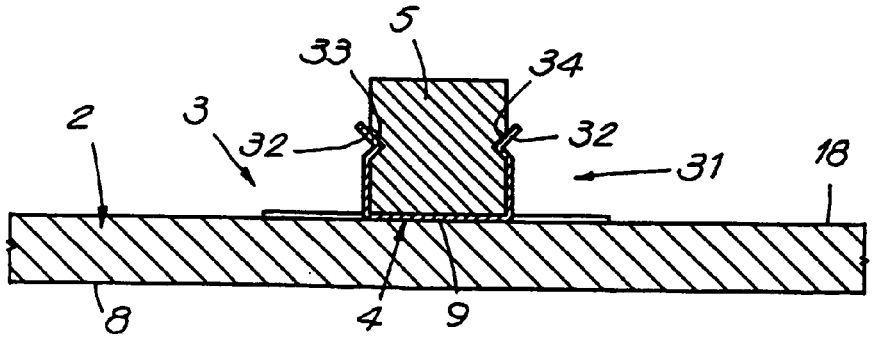
FIG. 10 shows a cross-section according to line X—X in FIG. 9, when assembled.

FIGS. 9 and 10 represent a variant whereby the holder 4 is provided with clamping means 31 with which it can be fixed on an underlying structure, in particular snapped in it. In the given example, these clamping means 31 consist of elastically bendable elements 32 which can work in conjunction with recesses 33–34 in the laths 5.

Figure 11:
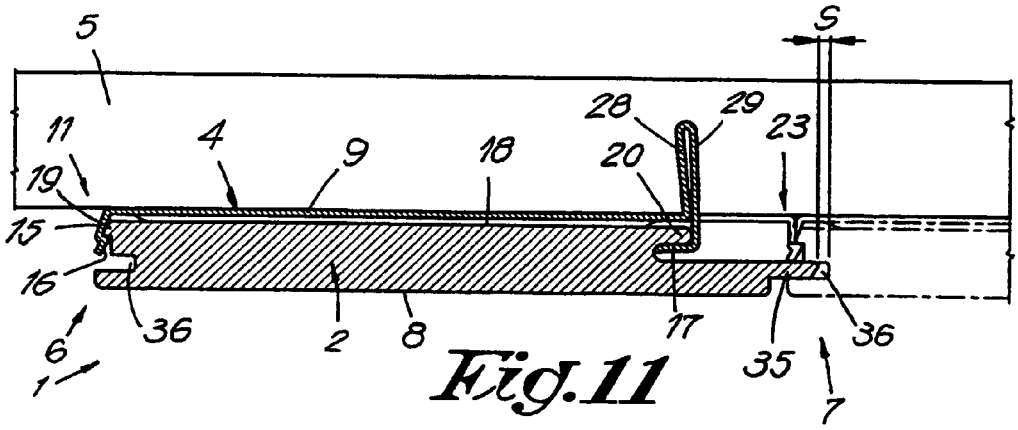
FIGS. 11 and 12 show two more variants of the invention.

FIG. 11 represents a variant whereby the panels 2 mesh directly by means of a tongue and groove joint, formed of a tongue 35 and a groove 36. This offers the advantage that the panels 2 cannot sag in relation to one another. The whole is made such that there is a lateral play S in the assembled condition, which makes it possible to laterally move a panel 2 against the spring force of the fixing parts 12 and 13, such that it can be turned down on the edge 6. When such a panel 2 is mounted again, one proceeds in the opposite sense. This makes it possible for the panel 2 to be removed in this case as well from an already installed covering, and to be put back in place again.

Figure 12:
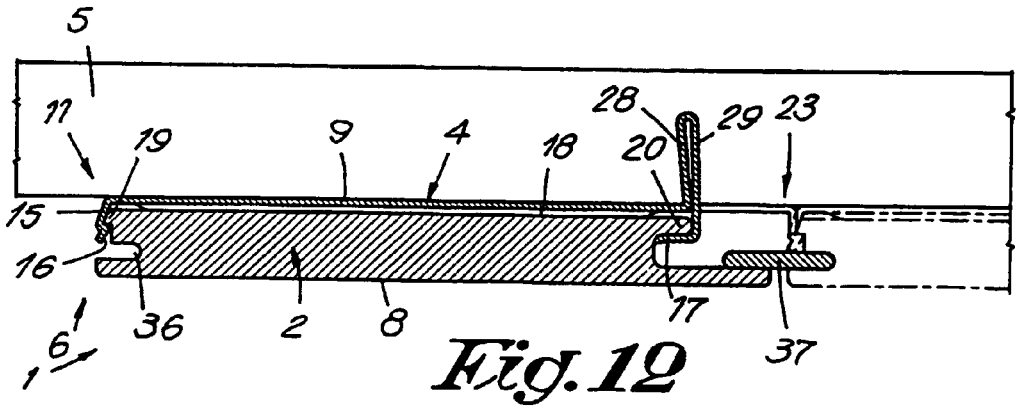

FIG. 12 represents a variant whereby the panels 2 mesh indirectly in and/or behind one another by means of inserted elements, in this case strips 37. These strips may for example be of another colour than the panels 2.

Figure 13:
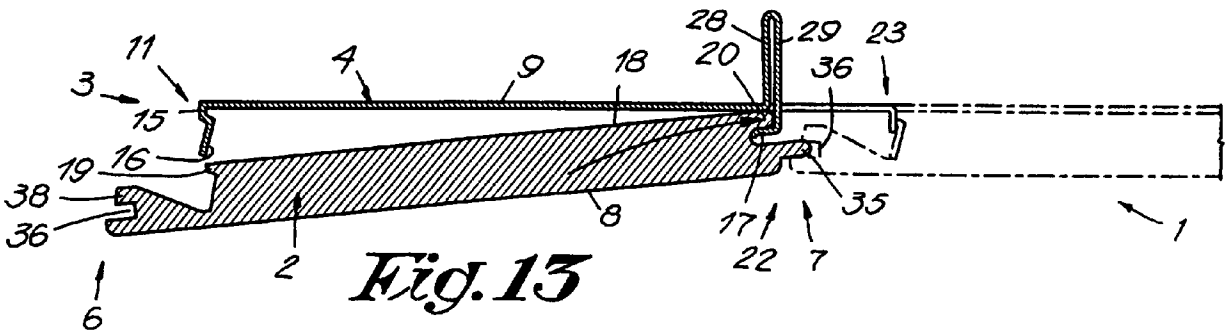
FIGS. 13 to 15 show another variant for three different positions.
Figure 14:
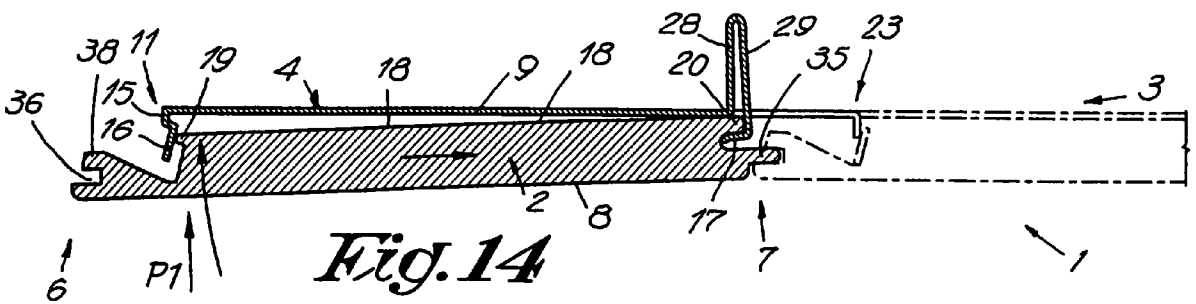
Figure 15:
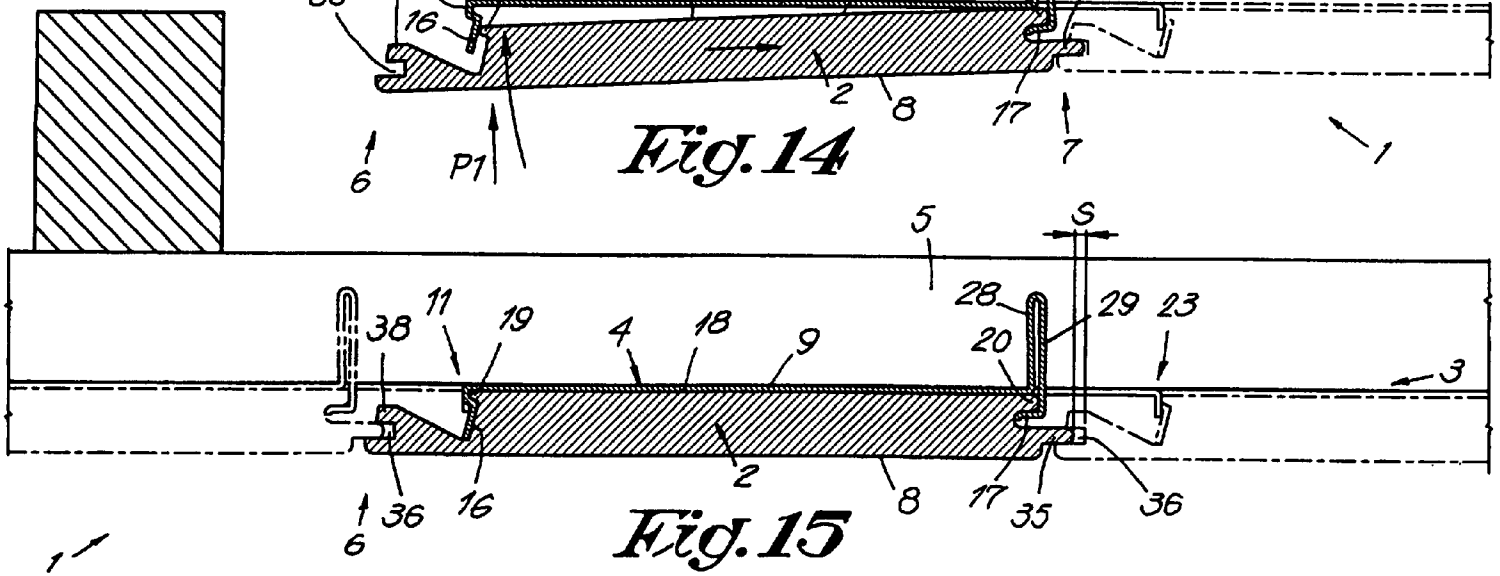

FIGS. 13 to 15 represent a variant of an embodiment whereby the panels 2 also fit into one another by means of a tongue 35 and a groove 36, on the edges 7 and 6 respectively.

A particular characteristic of this embodiment consists in that the coupling part on the edge 6, which in this case is formed by the groove 36, is situated outside the fixing parts 10 and 11 in the assembled condition. In this manner is obtained that the fixing parts 10 and 11 cannot possibly be placed in front of the groove 36.

Another special characteristic of this embodiment is that on the edge 6, on the place P1 where a pressure force has to be exerted during the assembly, the panel 2 is not weakened by the presence of the groove 36.

Another special characteristic consists in that also the coupling part on the other edge 7, in this case the tongue 35, is situated outside the fixing parts 12 and 13.

It should be noted that also in the embodiment of FIGS. 13 to 15, there is a play S which makes it possible for a panel 2 to be still removed from an existing covering by successively moving it laterally and by turning it down.

Further, as represented in the figures, the tongue 35 and the groove 36, as well as the fixing parts 10–11, are preferably dimensioned such that a panel 2, after it has been put in the fixing parts 12 and 13 on the edge 7, can simply be put in place by pushing it up on the edge 6. The panel 2 hereby slides with the collar 19 along the guiding part 16, as a result of which the panel 2, as represented in FIG. 14, is moved to the right against the elastic force of the fixing parts 12–13. In the case of an already formed covering, the upper lip 38 consequently moves freely along the far end of the tongue 35. As soon as the collar 19 is situated in front of the hook-shaped part 15, the panel 2 is forced to the left again, as a result of which the panel 2 slides with the groove 36 over the tongue 35.

As represented in FIG. 2, the panels 2 can possibly also be provided with a tongue 39 and a groove 40 respectively on their crosscut ends.

Although only separate holders 4 are represented in the figures, it is clear that, according to a variant, use can also be made of holders in the shape of a profile equipped with several pairs of fixing parts 10–11 and 12–13.

Nor is it inconceivable to realise the fixing parts 10 and 11 on the one hand, and the fixing parts 12 and 13 on the other hand as separate, whereby they should be positioned at a correct distance from one another.

Instead of the two fixing parts 10 and 11, also one fixing part can be used. The same applies to the fixing parts 12 and 13.

The above-mentioned holders 4, which will also be described hereafter, can be made of metal or plastic or any other suitable material whatsoever.

An example of an embodiment which is particularly suitable to be made of plastic is represented in the FIGS. 16 to 20. The general construction can be compared to that of the embodiment of FIG. 8, with as a sole, major difference that the represented holder 4 has only one pair of fixing parts 10–12, instead of the two pairs in FIG. 8. This makes the construction simpler and requires less plastic.

Figure 20:
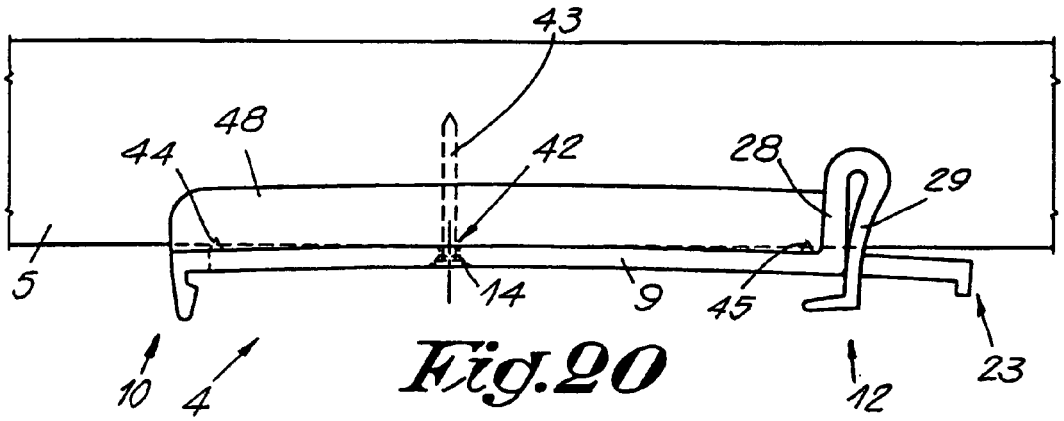
FIG. 20 represents a view according to arrow F20 in FIG. 19.

The holder 4 of FIGS. 16 to 20 is provided with means 41 which guarantee a good grip while said holder 4 is being mounted on a base, even when this holder 4, as represented, is fixed to the base in only one point 42, by means of only one nail 43 or such, which is applied through one central opening 14. In the given example, these means 41 consist of two points of support 44–45 which are situated on either side of the above-mentioned point 42 and which are made such that the body 9 is slightly bent when being mounted, as represented in FIG. 20, so that the holder 4 is tightened against the base on both points of support 44–45. As said points of support 44–45 are situated at a distance from one another, and due to the fact that they are both pressed onto the base, a rotation around the point 42 is excluded.

In the given example, the points of support 44–45 consist of triangular, crosswise directed ribs. However, it is clear that points of support in other shapes are possible.

The holder 4 of FIGS. 16 to 20 is also equipped with positioning means 46 which simplify a quick positioning in relation to the base, which consist of a supporting surface 47, with which the holder 4 can be laterally pressed against the above-mentioned lath 5 or such.

The supporting surface 47 is formed by the side of a rib 48 which is provided at right angles on the bottom side of the body 9 and which, together with this bottom side, forms an L-shaped seating which allows for a smooth positioning. During the assembly, the holder 4 can then be pressed in the corner with one hand, which is formed of the preceding, already mounted panel 2 and the lath 5, with the stopping part 23 against the edge of the preceding panel 2 and with the supporting surface 47 against the side of the lath 5. With the other hand, the nail 43 can be shot through the opening 14 by means of a pistol.

The supporting surface 47 also prevents the holder 4 from rotating in case it should be fixed in a single point 42 as mentioned above.

The fixing in a single point 42 offers the advantage that the time required for the installation of a ceiling is restricted.

Figure 21:
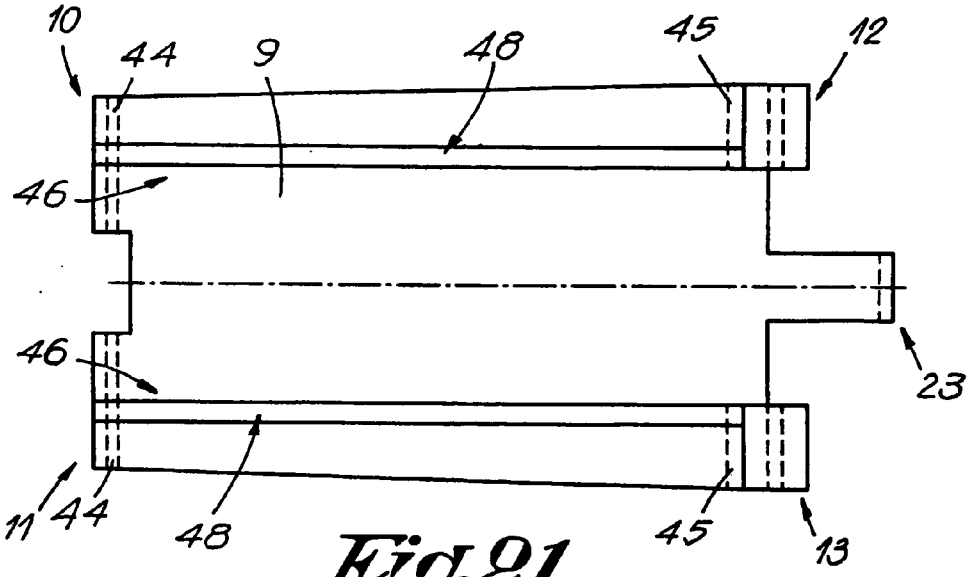
FIG. 21 represents a top view of another variant of the holder in FIG. 17.

It should be noted that all structural characteristics of an embodiment in plastic can be also be integrated in a metal embodiment and vice versa. In particular, this implies that the single embodiment of FIGS. 16 to 20 can also be realised in metal, and the double embodiment of FIG. 8 also in plastic. Such a double embodiment in plastic is represented for clarity's sake as seen from above in FIG. 21.

In case the holders 4, as described above, are provided with parts 28 and 29, the part 29 is preferably made such that, in a state of rest, it is pressed against the part 28 with a certain force F, as is indicated in FIG. 16 by way of example. As a consequence, the position of the lower end of the part 29, and thus of the hook-shaped part 17 is always correct, thus excluding that the distance between the hook-shaped parts 16 and 17 might vary due to differences in the elasticity of the part 29.

Figure 22:
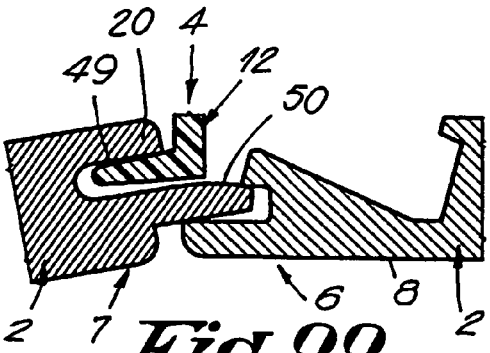
FIGS. 22 and 23 represent some more details regarding the covering according to the invention.
Figure 23:
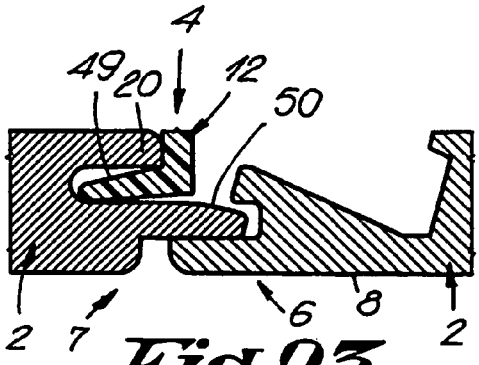

FIGS. 22 and 23 show how the panels 2 and/or the fixing parts, in this case the fixing part 12, can be provided with bevels and/or roundings, 49 and 50 respectively which simplify the turning in and out of a panel 2.

Figures 24, 25, 26:
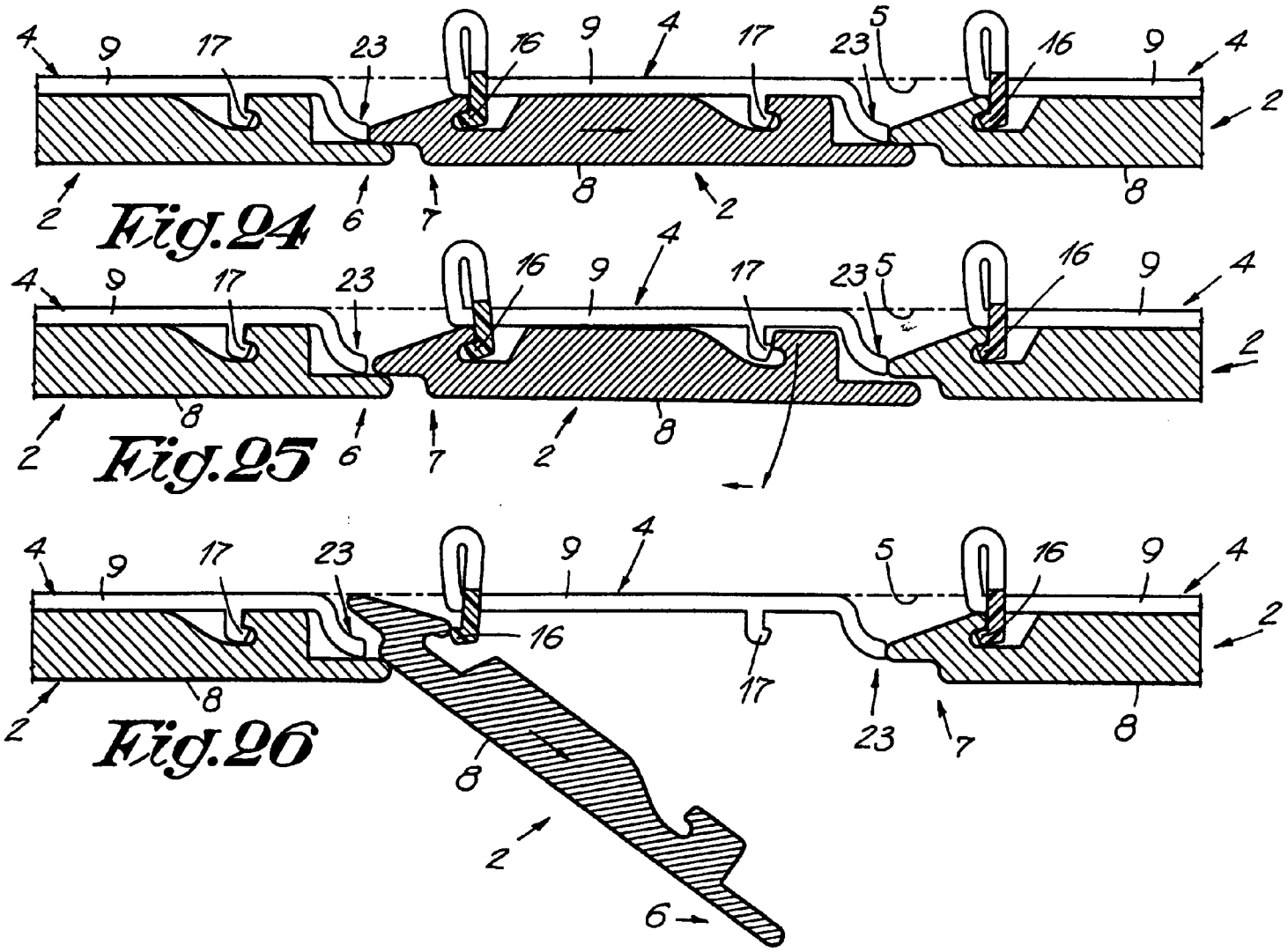
FIGS. 24 to 26 represent another variant of the invention, such for different conditions.

The fixing parts can be provided with hook-shaped parts 16 and 17 which are directed towards one another, as in the above-described embodiments, as well as with hook-shaped parts 16 and 17 which are directed away from one another. An example of this second possibility is represented as an illustration in FIGS. 24 to 26. FIG. 24 represents the assembled condition, whereas FIGS. 25 and 26 show how a panel 2 can be removed from the covering. In order to mount the panel again, one must proceed in the opposite sense.

Figure 27:
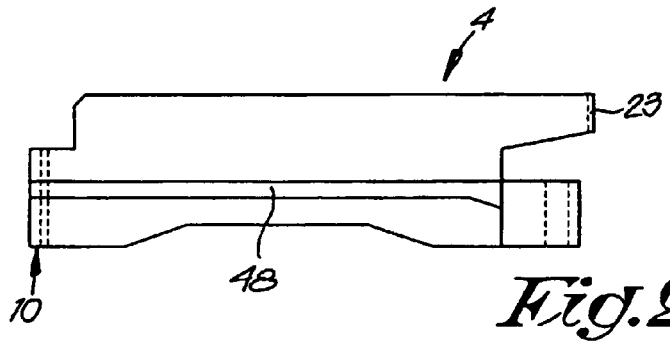
FIGS. 27 to 29 represent another variant of a holder according to the invention.
Figure 29:
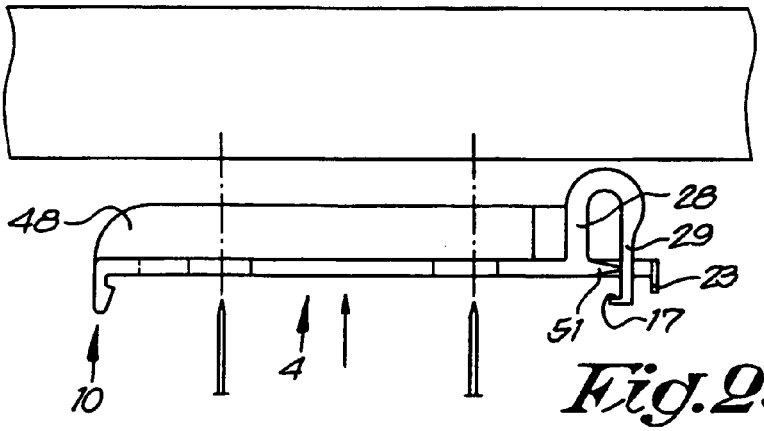

FIGS. 27 and 29 represent yet another variant of the embodiment of FIG. 18, in which the part 28 is provided with a stopping part 51 which is made in the shape of a local protrusion, so that a very precise end position is formed for the part 29.

Figure 30:
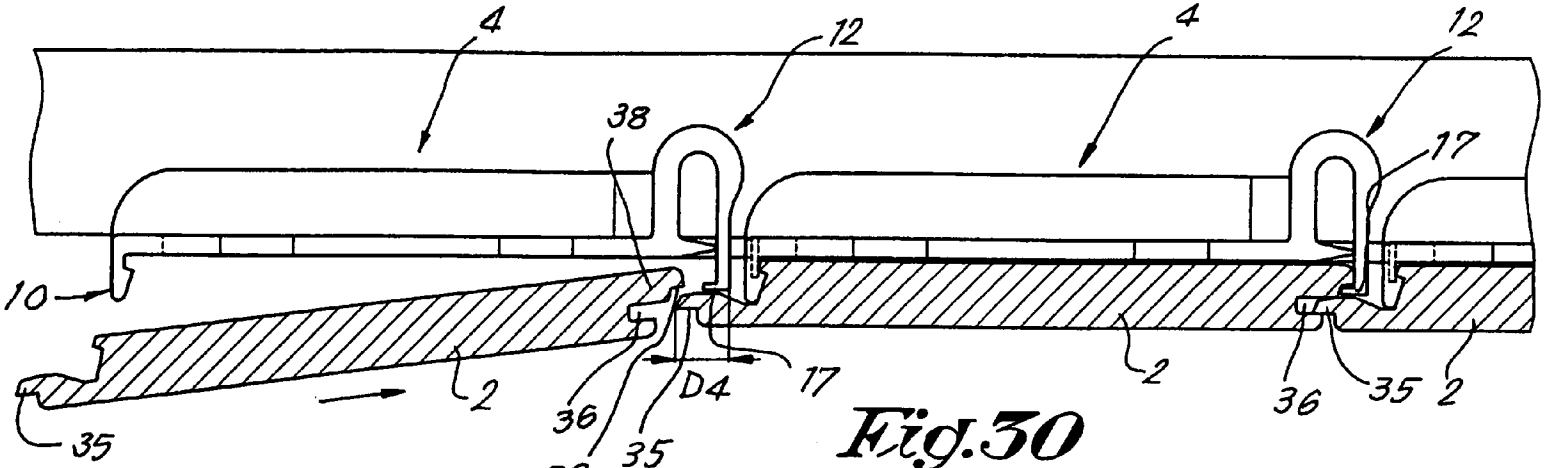
FIG. 30 represents another covering according to the invention.
Figure 31:
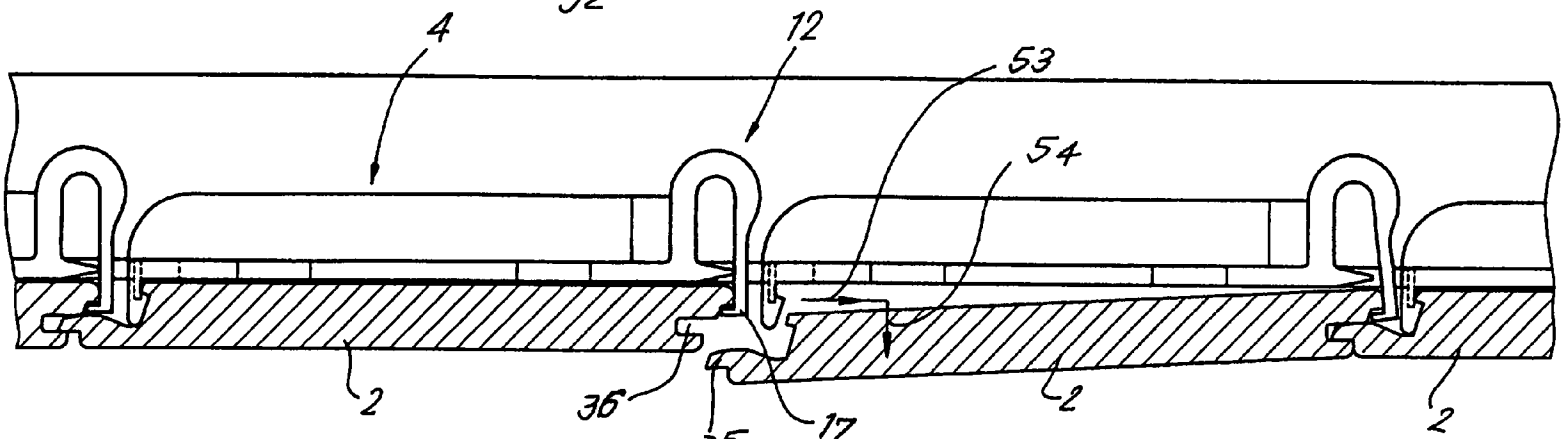
FIG. 31 represents for the covering in FIG. 30 how a panel can be removed from the covering.

FIGS. 30 and 31 represent a variant, which in a way is the mirrored image of the embodiment according to FIG. 15. The difference hereby resides in that the whole is made such that the panels 2, when being mounted, are provided with their groove 36 in the most flexible fixing part 12, whereas their tongue 35 is situated near the most rigid fixing part 10.

In relation to the embodiment from FIGS. 13 to 15, the embodiment according to FIGS. 30–31 offers the advantage that the panels 2 can be assembled in a smoother manner, with a smaller risk of wrong manipulations. When a panel 2 is applied according to FIG. 13, the collar 20 is less visible, and thus it may happen that, when a panel 2 is put with the tongue 35 in the groove 36 of an already mounted panel 2 at a relatively steep gradient, the collar 20 ends up under the hook-shaped part 17, which results in an incorrect assembly. In the embodiment according to FIGS. 30 and 31, this is practically excluded. When a panel 2, as represented in FIG. 30, is fixed, with its groove 36 shifted over the tongue 35 of the already mounted profile, one automatically obtains a positioning whereby the upper lip 38 ends up behind the hook-shaped part 17.

It should be noted that the embodiment of FIGS. 30 and 31 has two aspects which promote the easy hooking of a panel 2, namely that, as mentioned above, the panels 2 are situated with the groove 36 near the most flexible fixing part 12 on the one hand, and that the coupling part of the already mounted panel 2, in this case the tongue 35 of the preceding panel 2, extends at least up to near the fixing part 12 in front of the new panel 2 to be mounted on the other hand, in particular is situated at least partly under this fixing part 12, better still extends past it up to a certain distance, as indicated by D4 in FIG. 30.

The two above-mentioned aspects do not necessarily need to be combined. Thus, the second aspect could for example also be integrated in the embodiment of FIG. 15 by making sure that the groove 36, in particular the upper lip 38 which limits the groove 36, extends to underneath the hook-shaped part 17 of the first fixing part of the next panel 2.

As can be seen in FIGS. 30 and 31, a separate seating 52 is preferably formed in the upper lip 38 in front of the hook-shaped part 17, which preferably consists of a recess in the bottom side of the upper lip 38. Moreover, the upper lip 38 preferably extends farther than the lower lip.

The assembly and disassembly of the covering can be easily derived from FIGS. 30 and 31. The assembly is carried out by applying a panel 2 as represented in FIG. 30 at an angle in the holder 4, whereby it is shifted with the groove 36 over the tongue 35 of the already installed preceding panel 2, and by subsequently rotating the new panel 2 until it snaps in behind the fixing part 10. The disassembly is carried out as represented in FIG. 31. The panel 2 to be dismounted is first shifted aside as indicated by the arrow 53, so that the tongue 35 of this panel 2 is released from the groove 36 of the panel 2 lying next to it, after which the panel 2 to be removed is rotated out of the covering as indicated by the arrow 54. To mount it again, one proceeds in the opposite sense.

Figure 28:
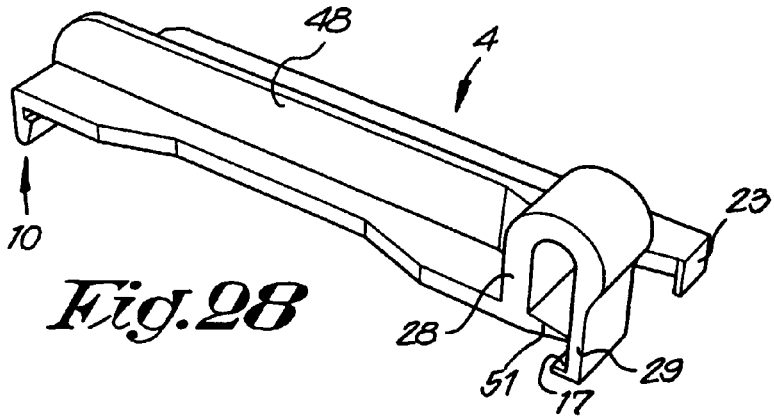
Figure 32:
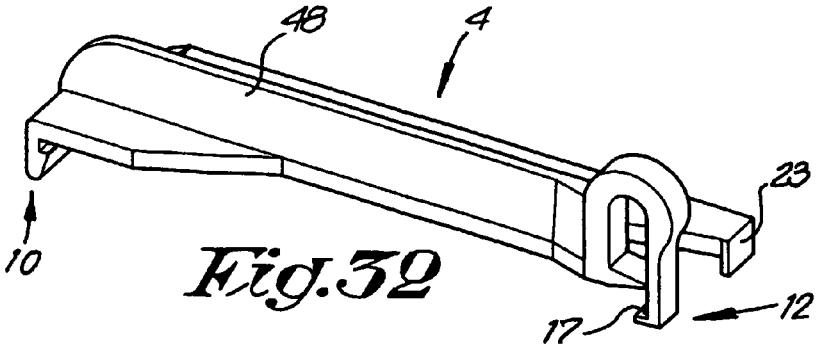
FIGS. 32 to 34 represent some more variants of holders.

FIG. 32 represents a lighter embodiment of the holder 4 of FIG. 28. The fixing part 12 hereby has a restricted width, in particular a width which practically coincides with the thickness of the rib 48. As will be further explained, the fixing part 12 must not always be able to absorb a large vertical force, and it is sufficient if this part, together with the far end of the holder 4 concerned, is made relatively light, for example when the panels support each other mutually by means of a tongue and groove joint. The holder 4 must then only be rigid near the other end, in this case near the fixing part 10. Also, the holder must then only be fixed to one far end, with for example only one nail.

Figure 33:
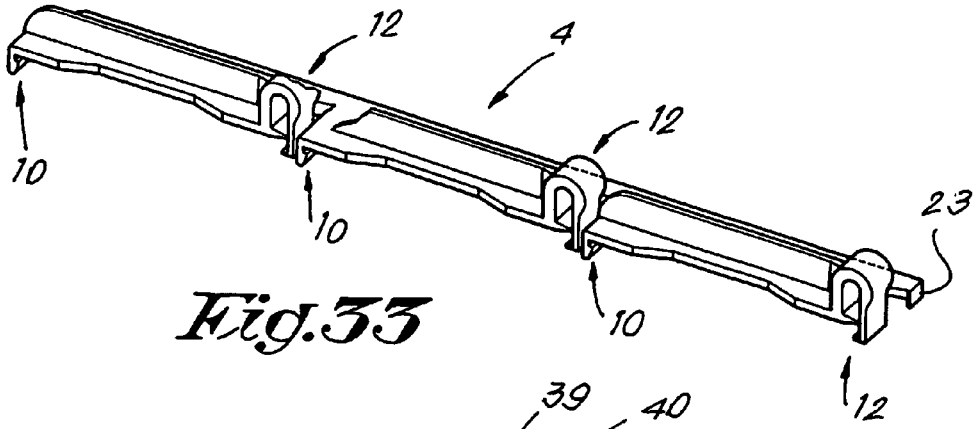

It is clear that, according to a variant, the holders 4 can be made as a profile or longitudinal structure with several pairs of fixing parts, whereby each holder 4 can then work in conjunction with several successive panels. An example thereof is represented in FIG. 33, which represents a multiple holder 4 made in one piece which actually consists of the coupling of three holders according to FIG. 28. According to a variant which is not represented, use can also be made of separate holders 4, for example as represented in FIG. 28, which are then fixed at even distances on an endless belt, for example a relatively flexible band made of plastic, metal or any other material whatsoever, onto which they are welded, glued, stapled or such. This is advantageous in that such a band with the holders 4 fixed on it can be rolled up and that, during the assembly of a covering, the required lengths can be cut off. The band can be made of such a flexible plastic that it is sufficiently bendable to be rolled up, but still sufficiently rigid to be able to guarantee a fixed distance between the holders 4 fixed upon it when rolled off.

Nor is it excluded to make use of one common base, for example in the shape of a profile, onto which several pairs of fixing parts are attached, for example are snapped in. The above-mentioned profile can replace the lath 5.

In the latter case, the fixing parts may consist of separate parts which then need to be applied as separate to the common base, as well as of elements containing several fixing parts, for example pairs of fixing parts, and which can be applied as such to a common base. A pair of fixing parts formed as a whole can hereby be made both of fixing parts which are designed to co-operate with the opposite coupling parts, in particular the edges 6–7 of a single panel, and of fixing parts which are designed to work in conjunction with a coupling part, for example the edge 6, of a single panel 2 and with a coupling part, for example the edge 7, of a panel 2 mounted next to it respectively.

Figure 34:
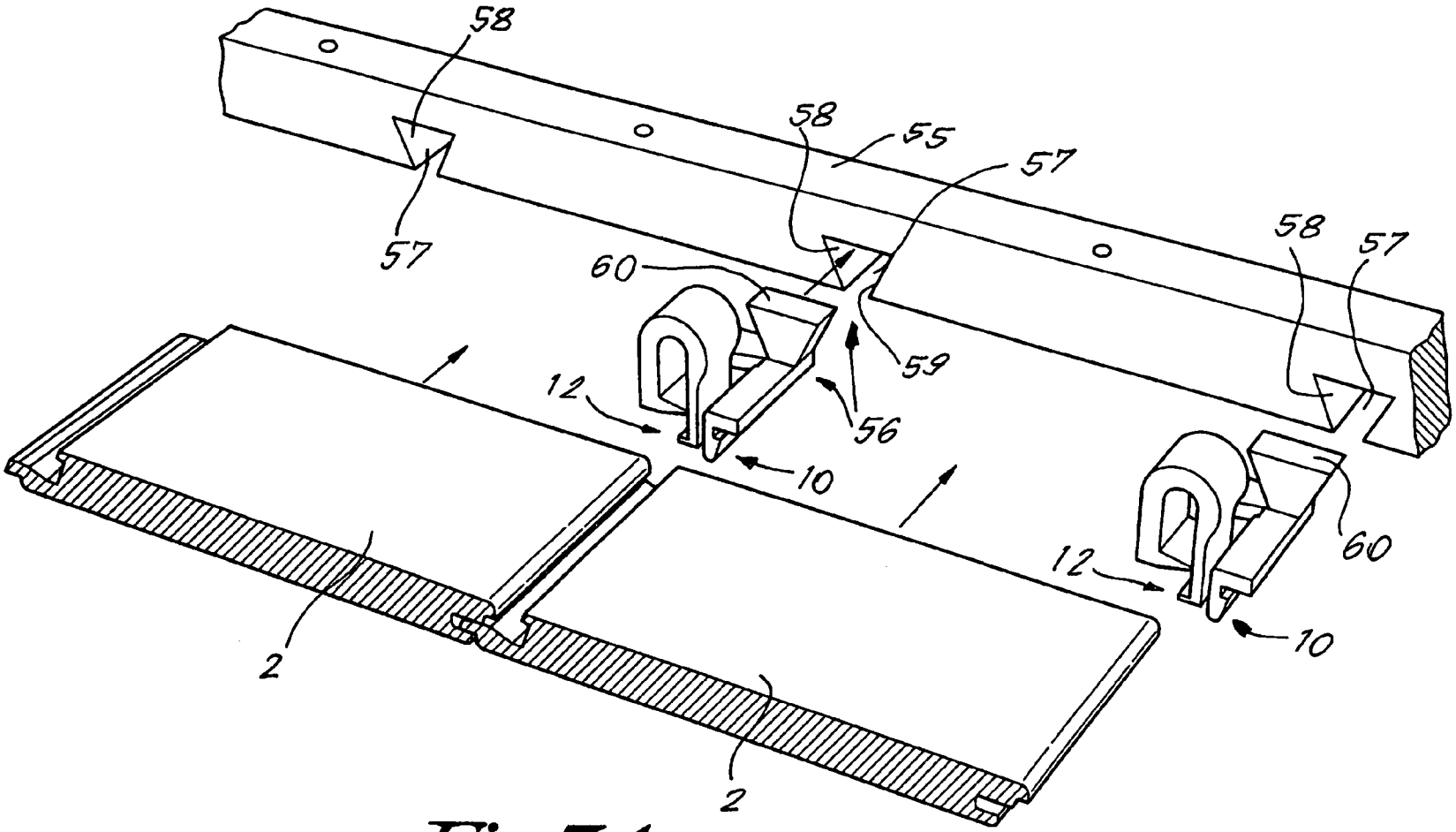

An example of the above-described latter possibility is described in FIG. 34. Hereby, two fixing parts 10 and 12 situated next to one another are connected in one piece to form a compact element which can be fixed on a profile 55 or another spacer lug by means of coupling means 56, which in this case consist of fitting parts in the shape of a seating arrangement 57 in the profile 55 on the one hand, which is provided with slanting walls 58–59, and a dovetailed part 60 which fits in the seating 57 on the other hand by movement generally parallel with the principal plane of the panels 2. In order to prevent the whole from shifting out of the seating 57, a snap-in system can possibly be integrated in the seating 57.

According to another variant, any fixing part can be part of a separate holder, whereby, in order to fix a panel on both edges, two holders must then be provided on the base.

According to yet another variant, instead of stopping parts 23 which are designed to work in conjunction with the edge of an already installed panel 2, the holders can be provided with stopping parts which can work in conjunction with a preceding holder, or even with coupling parts which make it possible for successive holders to be coupled to one another, or at least to be positioned in relation to one another.

Figure 35:
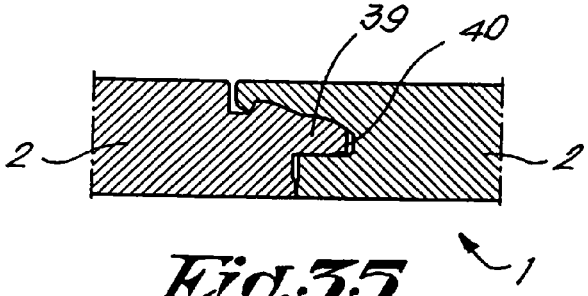
FIG. 35 represents how the crosscut far ends of the panels can be interlocked.

The panels 2 can possibly also be provided at their crosscut ends with coupling parts which provide at least for a locking at right angles to the surface of the covering 1, for example, as mentioned above, by making use of a tongue 39 and a groove 40. According to a variant, not only an interlocking at right angles to the surface of the covering 1 can be provided for, but also in a direction parallel to the surface of the covering 1, for example by making use of coupling parts which snap into one another. An example thereof is represented in FIG. 35, in which is represented a tongue and groove profile which can be put together by means of rotating as well as by means of shifting and which is analogous to the one represented in FIGS. 22 to 25 of European patent No. 0.843.763, with this sole difference that, for the application of a ceiling covering, it is carried out upside down. Naturally, other connecting systems are not excluded.

Figure 36:
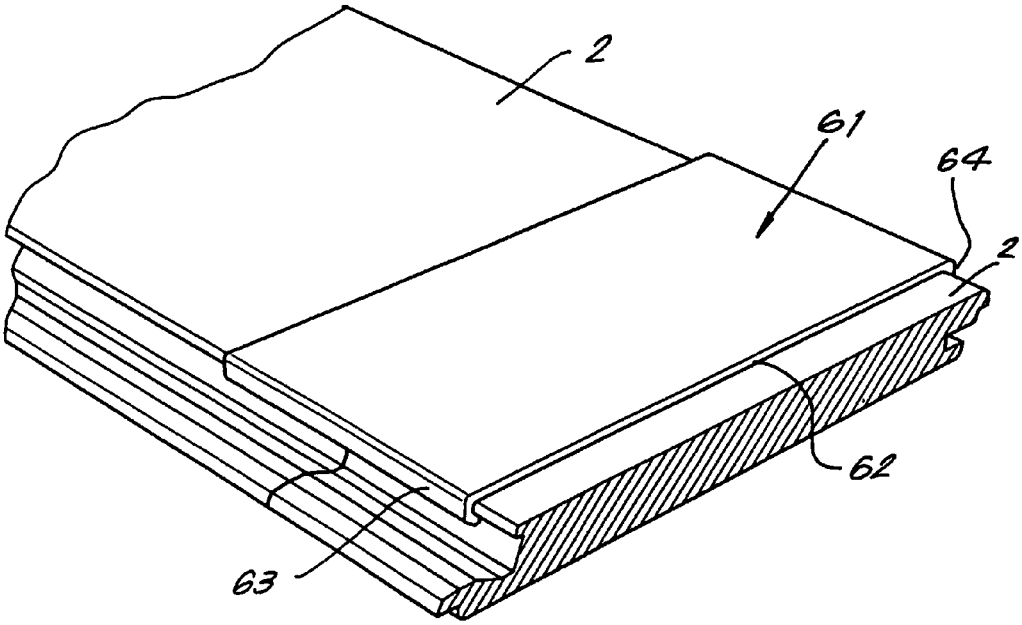
FIG. 36 represents an auxiliary element that can be used for the covering according to the invention.

FIG. 36 represents an accessory 61 with which the crosscut ends of two panels 2 situated in line can be centred. This accessory 61 consists of a body 62 which can surround the back side, the top side of the panels 2 on the crosscut far ends respectively, and of bent edges 63 and 64 formed on said body 62 which can work in conjunction with the edges of the respective panels 2.

Figure 37:
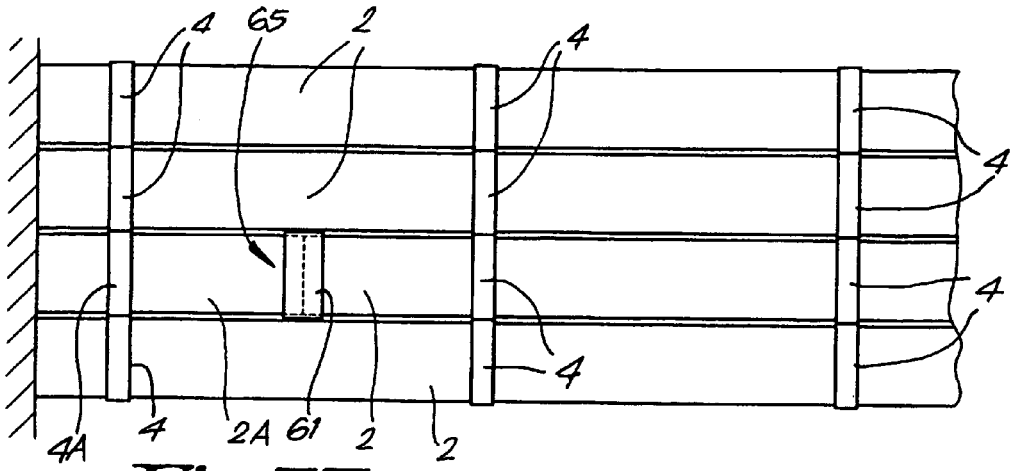
FIG. 37 schematically represents how the auxiliary element of FIG. 36 can be of use.

Such an accessory 61 can in principle be provided on each transition between two panels 2, so as to exclude possible mutual shifts between the crosscut far ends, but it is particularly useful in the case of very short panels 2, which are fixed in a holder 4 in only one place. This is illustrated in FIG. 37, in which is represented the back side of a covering 1, for example a ceiling covering, with panels 2 which are fixed by means of schematically represented holders 4. As the holders 4 are normally situated at regular distances from one another in rows, it is clear that a possible short panel 2A is only held in a holder 4A in a single place, and that this panel 2A could in principle make a slight lateral movement at the far end 65. However, by providing an accessory 61 on the far end 65, in particular by sliding it over the crosscut ends of the adjacent panels 2 and 2A, such a lateral movement is excluded.

Although the invention is in the first place meant for a ceiling or wall covering, it is clear that it is not limited to it. It is for example also possible to apply the covering 1 according to the invention as a floor covering, whereby the whole is then applied upside down. In this case, the above-mentioned holders 4 can be mounted on underlying laths or beams, instead of laths 5 which are fixed against a supporting structure of a wall or ceiling.

One can get a good idea of this by for example turning the FIGS. 1, 2, 4, 7, 11, 12, 13–15, 24–26 and 30–31 over 180°.

According to a variant, the holders 4 can also be simply placed on the subfloor, whereby measures must be taken, however, to make sure that a mutual connection is maintained. According to a first possibility, the panels 2, which in this case consist of floor panels, can rest on the holders 4. According to a second possibility, the holders 4 can also be made so thin that they have no effect whatsoever on the actual structural support of the panels 2, but are only designed to lock the panels 2, i.e. the floor panels, in relation to one another, both horizontally and vertically. In the latter case, the covering is particularly appropriate for the application of floating floors, for example laminate floors, on a flexible and insulating underlayer. The holders 4 are hereby pressed locally in the underlayer, whereas the panels 2 mainly rest on the underlayer over the entire surface.

Figure 38:
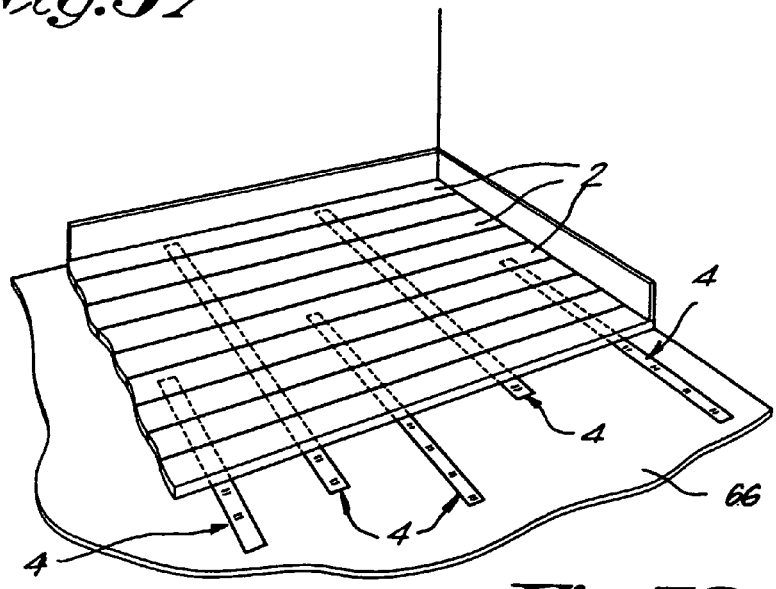
FIG. 38 represents a covering according to the invention, realised as a floor covering.
Figure 39:
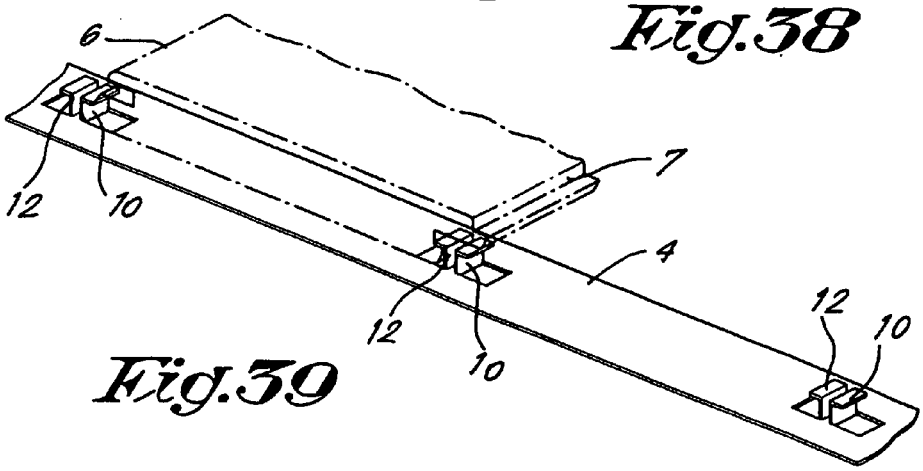
FIG. 39 represents a holder from the covering of FIG. 38.

An example of this latter possibility is represented in FIGS. 38 and 39, whereby strip-shaped holders 4 are laid on an underlayer 66, and whereby the panels 2 are systematically snapped-in on it. The holders 4 hereby each have several pairs of fixing parts 10–12 which are made analogous to the above-described fixing parts, whereas the panels 2 have profiles 6 and 7 on their edges which are also analogous to the profiles of the above-described panels 2. It is clear that thus is obtained a floor covering which makes it possible to remove a panel from any place whatsoever and to put it back and/or to replace it. It should be noted that the space between the panels 2, which is required to be able to laterally move the panels 2 against the force of the fixing means, can possibly be restricted to a minimum, so that also joints which are visible on the surface of the panel 2 are minimal. Possibly, the fixing parts which co-operate with the edge 6 as well as with the edge 7 can be made such that they can be laterally moved in a flexible manner, such that when a panel is removed, several panels lying next to one another can be laterally pushed aside. This makes it possible for the panels 2 to mesh relatively far, for example with their tongue 35 and groove 36, or with other overlapping parts, whereas the mutual clearance between two successive panels 2 can be kept relatively small. When a panel 2 is disassembled, this panel 2 can then be shifted together with several adjacent panels, so that the clearances of the different panels cumulate, and a sufficiently large shift can be realised on the place of the panel 2 to be removed to allow for a disconnection without disconnection of the adjacent panels from respective holders.

Figure 40:
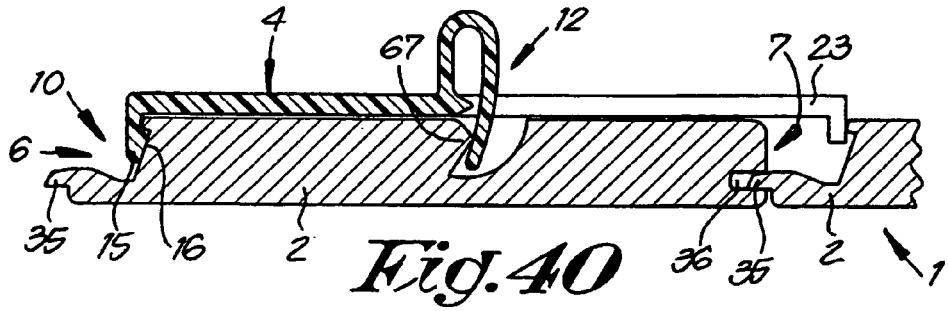
FIGS. 40 to 44 represent some more variants of the invention.

FIG. 40 represents a variant which makes it clear that the fixing parts 10 and 12 do not necessarily both have to be equipped with a hook-shaped part. In this example, the panel 2 is mainly kept up, on the left side of the figure, by the hook-shaped part 15 which in this case is made relatively rigid on the one hand, and, on the right side of the figure, by means of the tongue and groove joint. The fixing part 12 exerts a pressure force almost exclusively in the horizontal direction and offers practically no vertical resistance. The latter is mainly obtained thanks to the co-operation with the next panel 2.

FIG. 40 further makes it clear that the fixing parts of the holder 4, in this case the fixing parts 10 and 12, do not necessarily have to be situated near the edges 6–7 of the panel 2. The fixing part 12 is hereby situated in the middle of the panel 2 and works in conjunction with a part 67 formed to this end on the panel 2.

Figure 41:
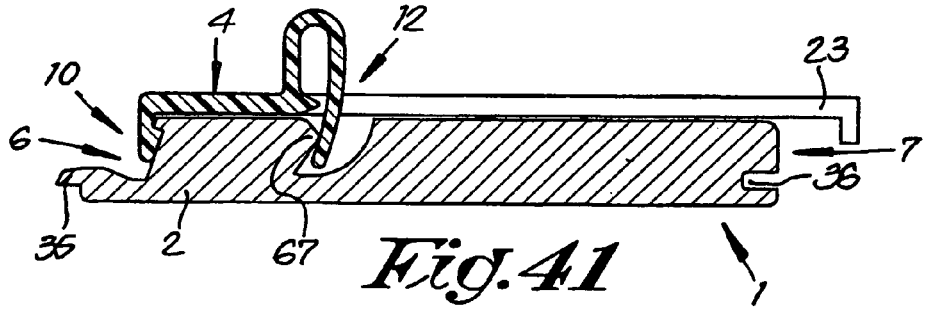

FIG. 41 shows another variant whereby both fixing parts 10 and 12 are situated in the same half of the panel 2.

Naturally, according to a variant which is not represented, both fixing parts 10 and/or 11 on the one hand, and 12 and/or 13 on the other hand, can be situated at a distance from the actual edges 6–7.

It should be noted that in the embodiment of FIGS. 40 and 41, the part 12 preferably offers a slight resistance in the vertical direction, such that this panel 2 remains suspended as such, also as long as there is no meshing with another panel 2 situated next to it.

Figure 42:
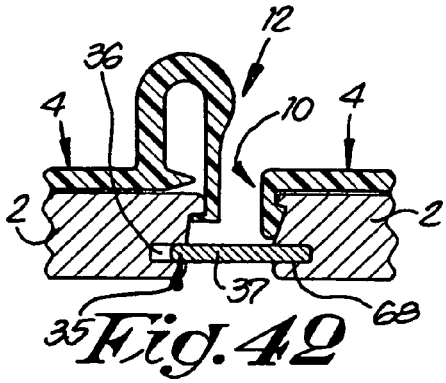
Figure 43:
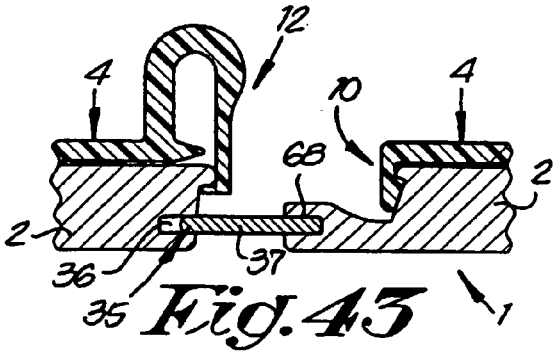
Figure 44:
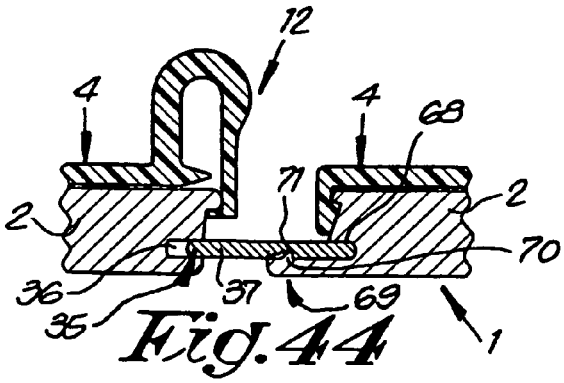

FIGS. 42 to 44 represent three variants whereby the above-mentioned tongue and groove joint is formed by means of an inserted element, in this case a strip or spline 37, whereby there is enough play to disassemble the panels 2 separately, without having to remove the adjacent panels.

The strips or splines 37 are hereby preferably fixed tightly in the seatings 68 provided to this end, either during the manufacturing of the panels 2, or during the assembly of the covering. This offers the advantage that the strips 37 always remain in place in the cross direction, so that the whole can always be disassembled.

In the embodiments of FIGS. 42 and 43, such a tight connection can be realised by clamping and/or by gluing the strips 37 in the seatings 68. According to the embodiment of FIG. 44, use is made of a mechanical interlocking 69, which in this example consists of a protrusion 70 on the panel 2 which meshes in a recess 71 in the strip or spline 37. Naturally, such a mechanical interlocking 69 can also be realised in other ways. Such a mechanical interlocking 69 offers the advantage that the strips or splines 37 can be shifted in the longitudinal direction and thus can be shifted nicely against one another.

It is clear that the strips 37 do not necessarily have to have the same length as the panels 2.

In order to make sure that the panels 2 are held even better in the holders 4, inclined contact surfaces, if there are any, are preferably made self-locking. This applies among others to the inclined contact surface, in particular the top surface, of the above-mentioned hook-shaped parts 16 and the contact surface of the panel 2 working in conjunction with it.

It is clear that the panels 2 can be made of any material whatsoever, and thus for example of extruded plastic or of metal. The panels 2 can be massive as well as hollow, or they may be formed of a bent, thin-walled plate.

It should be noted that the different characteristics, in particular the different possibilities for co-operation between a fixing part 10–11 or 12–13 and a panel 2 of the various above-described embodiments, can be mutually combined.

It is clear that the invention is also related to the elements of which said covering 1 is composed, in other words that it is also related to the holders 4 on the one hand and to the profiled panels 2 on the other hand.

Finally, the invention also concerns a method for installing, disassembling the above-mentioned coverings respectively, characterised in that use is made of panels which are provided with a tongue 35 and a groove 36 respectively on at least two opposite edges which can work in conjunction when assembled, whereby the method mainly consists in that holders 4 are first mounted with fixing parts which can work in conjunction with the above-mentioned edges, in particular holders 4 as described above, and in that the panels 2 are then provided in the holders 4 by first hooking them with one edge and by then rotating them into the plane of the covering to be realised, whereby not only the panels 2 are fixed between the fixing parts, but also the above-mentioned tongue 35 and groove 36 are coupled.

Further, this method is preferably characterised in that one or several of the steps are carried out as described above for handling the covering, and as represented in a number of the drawings.

According to the most preferred embodiment, the proceedings are as represented in FIGS. 30 and 31, whereby the panels 2 slide with their edge provided with the groove 36 over the tongue 35 of the preceding panel 2, whereas the accompanying interlocking part is laterally bent, such that it hooks in the opposite interlocking part.

The disassembly is carried out in the opposite sense.

It is clear that the method according to the invention concerns both the assembly and disassembly of the covering, systematically as of one edge, as well as the assembly and disassembly in the covering of only one or possibly several panels 2 which are situated in the middle of an already existing covering 1.

The present invention is by no means limited to the above-described embodiments represented in the accompanying drawings; on the contrary, such a covering and the components thereof can be made in different shapes and dimensions while still remaining within the scope of the invention.

The invention claimed is:

1. Covering for a surface, comprising a number of successive panels, and fixing means therefor, said fixing means comprising holders including fixing parts, said fixing parts arranged to engage and retain the panels in a disconnectable manner over a part of the thickness of the panels; said panels being mounted in rows, and after they have been mounted on the holders, can be separated from their respective holders and removed without disengaging the panels which are located in the adjacent rows on either side from their respective holders, and wherein the panels mesh on their edges by means of a tongue and groove joint, either directly or by means of an inserted element, said meshing including locating of a tongue within a groove.

2. Covering for a surface, comprising a number of successive panels, and fixing means therefor, said fixing means comprising holders including fixing parts, said fixing parts including at least one fixing part on one side of the holder arranged to engage and retain the panels at least on one side of the panels in a disconnectable manner over a part of the thickness of the panels and at least one other fixing part located on at least one other side of the holder arranged to facilitate a smooth, lateral, flexible bending, and so that in a direction perpendicular to the surface of the covering a firm interlocking is enabled;

said other fixing part including an elastically bendable lip which is bent backward out of the plane of the covering and then forward again, said lip comprising two lip parts, wherein a second lip part is made such that, in a state of rest when no panel has been provided in it yet, is pressed against a first lip part with a force (F), such that the position of a preferably hook-shaped lower end of the second lip part is always fixed.

3. Covering according to claim 1 or 2, wherein the holders are each provided with at least two fixing parts made in one piece with the holders, and which are arranged so as to co-operate with two edges or portions of one and the same panel respectively.

4. Covering according to claim 1 or 2, wherein the holders comprise separate elements which are fixable on a base, and wherein each holder cooperates with a respective single panel.

5. Covering according to claim 1 or 2, wherein the holders comprise elements fixable on a base, and wherein each holder includes fixing devices which are arranged to co-operate with several panels situated next to one another.

6. Covering according to claim 1 or 2, wherein the holders each include two fixing parts arranged to co-operate with edges or with panel portions situated near panel edges respectively, of two adjacent panels.

7. Covering according to claim 1 or 2, including a spacer and wherein said holders co-operate with said spacer.

8. Covering according to claim 1 or 2, wherein each holder includes a stopping part with which said holder can be positioned against a panel or holder part of a covering which has already been installed.

9. Covering according to claim 8, wherein the stopping part is formed of a protruding lip which functions as a spacer.

10. Covering according to claim 8, wherein the holder (4) has a configuration, on the side where the stopping part is situated, and on the opposite side thereof, such that when several of said holders are mounted one after the other, the stopping part of the one holder can be freely located against the edge of the panel which is being held by the other holder.

11. Covering according to claim 10, wherein each respective holder is provided with at least one stopping part on one edge, and is provided, opposite each stopping part, with a portion which leaves the edge of a clamped-in panel free.

12. Covering according to claim 1 or 2, wherein the holders include clamping devices which are arranged so as to enable the holders to be snapped-in on an underlying structure.

13. Covering according to claim 1, wherein the fixing parts are located on opposed sides of the holder; wherein the fixing parts of each holder cooperate with two edges or portions of one and the same panel; and wherein all the fixing parts located on at least one side of each holder include features which facilitate a smooth, lateral, flexible bending, and so that in a direction perpendicular to the surface of the covering a firm interlocking is enabled.

14. Covering according to claim 13, wherein said fixing parts comprise elastically bendable lips which are shaped by bending each lip backward out of the plane of the holder, and then forward again.

15. Covering according to claim 14, wherein each of the holders is equipped with a combination of one or several fixing parts which are formed of said elastically bendable lips which are shaped by bending each lip backward out of the plane of the holder and then forward again, each said bendable lips further including a hook-shaped part, and of one or more fixing parts which are provided with a relatively rigid hook-shaped part, and wherein at least one of the fixing parts also has an inclined guiding part.

16. Covering according to claim 14 wherein the elastically bendable lips which are bent backward out of the plane of the holder and then forward again, comprise two parts, wherein a second lip part is made such that, in a state of rest when no panel has been provided in it yet, is pressed against a first lip part with a force (F), such that a position of a preferably hook-shaped lower end of the second lip part is always fixed.

17. Covering according to claim 1 or 2, wherein the holders include gripping means which provide a tight grip when said holder is secured on a base.

18. Covering according to claim 17, wherein said gripping means comprises points of support which are located on either side of a fixing point and which are made such that the holder is slightly bent when being secured, so that the holder is tightened against the base on said points of support when secured on the base.

19. Covering according to claim 1 or 2, wherein the holders each include only one fastener fixing point.

20. Covering according to claim 1 or 2, wherein the holders include positioning means.

21. Covering according to claim 20, wherein the positioning means comprises a supporting surface, enabling the holder to be laterally pressed against a base, said supporting surface comprising an L-shaped seating together with the bottom side of the holder.

22. Covering according to claim 1, or 2 wherein the panels are provided with bevelled edges which facilitate the turning in and out of the panels relative to each other at the tongue and groove joints.

23. Covering according to claim 1 or 2, wherein the holders each comprise at least two pairs of fixing parts per panel to be held, said pairs situated on either side of a stopping part located in the middle of the holder.

24. Covering according to claim 1 or 2, wherein each holder comprises only one pair of opposed fixing parts engaging opposed edges or portions of each panel to be held.

25. Covering according to claim 1, wherein the fixing means, as well as said tongue and groove joint, enable the panels to be rotated along the side of the tongue during assembly and disassembly of the panels and holders.

26. Covering according to claim 25, including fixing parts located along the side of a tongue, each of said fixing parts located along the side of a tongue including features which include a smooth, lateral, flexible bending, and so that in a direction perpendicular to the surface of the covering a firm interlocking is enabled.

27. Covering according to claim 1, wherein the fixing means are arranged to cooperate with two edges or portions of one and the same panel, and the fixing means, as well as said tongue and groove joint, enable the panels to be rotated along the side of the groove during the assembly and disassembly of the panels and holders.

28. Covering according to claim 27, including fixing parts located along the side of the groove, each fixing part located along the side of the groove including features which facilitate a smooth, lateral, flexible bending, and so that in a direction perpendicular to the surface of the covering a firm interlocking is enabled.

29. Covering according to claim 1 or 2, wherein said inserted elements are connected to one panel such that they always occupy a specific lateral position.

30. Covering according to claim 1, wherein, the tongue and groove of the tongue and groove joint is formed in the panels, and at least one of the tongue and groove is located outside a respective fixing part when the panels are engaged and retained by the fixing parts.

31. Covering according to claim 1 or 2, wherein the panels are provided with parts fitting one after the other, and in that the part which is situated on one longitudinal edge of the panels, extends up to the vicinity of the fixing part of a following panel to be mounted.

32. Covering according to claim 31, wherein said part extends to underneath and beyond said fixing part.

33. Covering according to claim 1 or 2, wherein the panels comprise laths.

34. Covering according to claim 1 or 2, wherein the panels include connecting devices on their crosscut sides.

35. Covering according to claim 34, wherein the connecting devices provide for an interlocking, both in a direction which is at right angles to the surface of the covering and in a direction which is parallel to the surface of the covering.

36. Covering according to claim 1 or 2, wherein the panels have a massive core.

37. Covering according to claim 36, wherein the panels are made from a material selected from the group consisting of wood and a product having a wood base, including MDF or HDF.

38. Covering according to claim 1 or 2, wherein each of the holders include opposed fixing parts arranged to cooperate with one and the same panel, said holder including fixing parts on one side which are formed of a rigid, hook-shaped part.

39. Covering according to claim 1 or 2, wherein two or more panels are connected at their crosscut ends by means of an accessory, said accessory comprising a body having bent edges which co-operate with said edges of the panels.

40. Covering according to claim 1, wherein the panels are provided with rounded-off edges which facilitate turning in and out of the panels relative to each other.

41. Covering according to claim 1, wherein the panels are provided with beveled and rounded-off edges which facilitate turning in and out of the panels relative to each other.

42. Covering according to claim 1, wherein the fixing parts are provided with beveled edges with facilitate turning in and out of the panels relative to each other.

43. Covering according to claim 1, wherein the fixing parts are provided with rounded off edges which facilitate turning in and out of the panels relative to each other.

44. Covering according to claim 1, wherein the panels and fixing parts are provided with beveled edges which facilitate turning in and out of the panels relative to each other.

45. Covering according to claim 1, wherein the panels and fixing parts are provided with rounded off edges which facilitate turning in and out of the panels relative to each other.

46. Covering according to claim 1, wherein each of said panels, after having been mounted in their respective holders can be separated from their respective holders and removed without interference with the panels which are located in the adjacent rows on either side.

47. Covering for a surface according to claim 1, wherein, said fixing means comprise a common base and fixing parts, said fixing parts formed of plastic and being arranged to engage and retain the panels in a disconnectable manner, said fixing parts forming part of separate elements fixable on said common base, each separate element comprising one or more fixing parts, said common base comprising a profile, said profile acting as a spacer for the separate elements, said separate elements fixable on said common base by means of coupling parts which are adapted to be connected to the profile by engagement with a cooperating seating arrangement of the profile by movement of the coupling parts in a lateral direction relative to the profile and generally parallel with the principal plane of the panels.

48. Covering for a surface according to claim 47, wherein said seating arrangement is arranged to receive said coupling parts by means of a snap-in connection.

49. Covering according to claim 2, wherein the panels overlap each other at their adjacent edges.

50. Covering according to claim 49, wherein the panels include overlapping parts on the opposite edges, whereby, when mounted, a first part of one panel is located behind a second part of an adjacent panel, and wherein a recess or free portion is provided on the second part, such that the one panel can always be freely rotated outward about the first part.

51. Covering according to claim 49, wherein the panels may be meshed together at their adjacent edges, but nevertheless may still be laterally shifted when mounted on said holders, against a spring force exerted by said elastically bendable lips, and wherein the meshing is such that a single panel can be removed from between the adjacent panels by shifting the panel parallel to the covering and by subsequently rotating the panel.

52. Covering according to claim 51, wherein each respective fixing part includes a guiding part arranged so that the panels, when being pressed in for engagement with the fixing parts, are shifted laterally and subsequently shifted back when mounted, whereby said guiding part ensures that the respective meshing parts first pass one another to subsequently mesh one after the other as a result of the shifting back.

53. Covering according to claim 2, including multiple other fixing parts comprising said at least one other fixing part that is located on one other side of the holder, wherein all of said multiple other fixing parts located on one other side of the holder are arranged to facilitate said smooth, lateral, flexible bending.

54. Covering for a surface, comprising a number of successive panels, and fixing means therefore, said fixing means comprising holders including opposed fixing parts, said fixing parts arranged to engage and retain opposed edges or portions of a single one and the same panel in a disconnectable manner over a part of the thickness of the respective panel;

said panels mounted on said holders in rows wherein the panels, after they have been mounted, can be separated from their respective holders and removed without disengaging the panels which are located in adjacent rows on either side from their respective holders;

wherein all fixing parts located on at least on one side of the holder are arranged to facilitate a smooth, lateral, flexible bending, and so that in a direction perpendicular to the surface of the covering a firm interlocking is enabled;

flexible bending of a bendable fixing part enabling a panel secured by said fixing part to be released from its respective holder upon movement of said panel in a direction causing flexible bending of said bendable fixing part in a direction enabling separation of a side of said panel opposite a side located at said bendable fixed part from a fixing part retaining said panel in direction perpendicular to a surface of the covering, to thereby release the panel from the firm interlocking with said fixing part.

55. Covering according to claim 54, wherein the holders comprise separate elements which can be individually fixed on a base, wherein each holder cooperates with a respective single one and the same panel.

56. Covering according to claim 54, wherein the holders comprise separate elements fixable on a base, each holder cooperating with a respective single panel, and each holder comprising two fixing parts made in one piece with the respective holder, said fixing parts arranged to cooperate with two edges or portions of one and the same panel respectively.

57. Covering according to claim 54, wherein said fixing parts comprise elastically bendable lips which are shaped by bending each lip backward out of the plane of the holder and then forward again.

58. Covering according to claim 54, wherein said panels and the fixing parts opposite laterally bendable fixing parts of a holder are configured such that when a panel is inserted with one edge behind a laterally bendable fixing part of a holder the panel may be fixed by urging it upward into engagement with the opposite fixing part of the respective holder.

* * * * *

UNITED STATES PATENT AND TRADEMARK OFFICE

CERTIFICATE OF CORRECTION

PATENT NO. : 7,010,894 B1
DATED : March 14, 2006
INVENTOR(S) : Mark Gaston Maurits Cappelle It is certified that error appears in the above-identified patent and that said Letters Patent is hereby corrected as shown below:

Title page,
Item [22], PCT Filed: should read -- Nov. 22, 2000 --.

Signed and Sealed this

Twenty-third Day of May, 2006

JON W. DUDAS
*Director of the United States Patent and Trademark Office*